US011091917B2

(12) United States Patent
MacPherson et al.

(10) Patent No.: US 11,091,917 B2
(45) Date of Patent: Aug. 17, 2021

(54) CLADDING ELEMENT

(71) Applicant: James Hardie Technology Limited, Dublin (IE)

(72) Inventors: Thomas Edward MacPherson, Batavia, IL (US); Robert Elliot Everhart, II, Lake Arrowhead, CA (US); Hui Li, Fontana, CA (US); Darren Southwell, Sydney (AU); Matthew Spencer, Palatine, IL (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/457,249

(22) Filed: Jun. 28, 2019

(65) Prior Publication Data

US 2019/0330856 A1 Oct. 31, 2019

Related U.S. Application Data

(60) Continuation-in-part of application No. 15/686,037, filed on Aug. 24, 2017, now Pat. No. 10,724,249,
(Continued)

(51) Int. Cl.
*E04F 13/08* (2006.01)
*E04F 13/14* (2006.01)

(52) U.S. Cl.
CPC ..... *E04F 13/0894* (2013.01); *E04F 13/0846* (2013.01); *E04F 13/148* (2013.01); *E04F 2201/026* (2013.01)

(58) Field of Classification Search
CPC ..... E04F 13/00; E04F 13/148; E04F 13/10; E04F 13/16; E04F 13/07; E04F 13/072;
(Continued)

(56) References Cited

U.S. PATENT DOCUMENTS 294,855 A * 3/1884 Crawford ..... E04F 13/0864 52/539
525,442 A * 9/1894 Burrows
(Continued)

FOREIGN PATENT DOCUMENTS

DE 3532112 3/1987
WO WO 2004/081316 9/2004

OTHER PUBLICATIONS

Ready Pine Refinished Interior Tongue & Groove by Horizon Coatings, "The Original," http://www.readypine.com/About.htm, as printed Mar. 11, 2015 in 3 pages.
(Continued)

*Primary Examiner* — Jessica L Laux
(74) *Attorney, Agent, or Firm* — Knobbe Martens Olson & Bear LLP

(57) ABSTRACT

A cladding element, for use in a building envelope, comprising a first face, a second face and a plurality of edges. One or more of the plurality of edges includes a mating feature configured to resist moisture passage between cladding elements when the cladding elements are installed on a wall or other structure. The mating features of each cladding element including one or more beveled edges designed to improve mating between the cladding elements and the overall aesthetic appearance of the mating interface between adjacent cladding elements when installed on a wall or other structure.

17 Claims, 26 Drawing Sheets

Related U.S. Application Data which is a continuation of application No. 14/838,217, filed on Aug. 27, 2015, now Pat. No. 9,752,328, application No. 16/457,249, which is a continuation-in-part of application No. 15/686,043, filed on Aug. 24, 2017, now Pat. No. 10,961,718, which is a division of application No. 14/838,217, filed on Aug. 27, 2015, now Pat. No. 9,752,328.

(60) Provisional application No. 62/042,758, filed on Aug. 27, 2014.

(58) Field of Classification Search
CPC . E04F 13/073; E04F 13/0864; E04F 13/0894; E04F 13/0846; E04F 13/08; E04F 13/0801; E04F 13/0817; E04F 13/0837; E04F 13/0844; E04F 13/085; E04F 2201/01; E04F 2201/04; E04F 2201/045; E04F 2201/048; E04F 2201/026; E04F 2201/02; E04F 2201/022; E04F 2201/028
See application file for complete search history.

(56) References Cited

U.S. PATENT DOCUMENTS

| | | | | |
|---|---|---|---|---|
| 2,110,729 | A * | 3/1938 | Hoggatt | E04F 13/10 52/448 |
| 4,955,169 | A * | 9/1990 | Shisko | E04F 13/0864 52/536 |
| 8,733,410 | B2 | 5/2014 | Pervan | |
| D729,949 | S * | 5/2015 | Hartman | D25/119 |
| 9,140,018 | B2 | 9/2015 | Southwell | |
| 10,240,348 | B2 | 3/2019 | Pervan et al. | |
| 2004/0206036 | A1 | 10/2004 | Pervan | |
| 2004/0231252 | A1 | 11/2004 | Benjamin | |
| 2010/0170182 | A1 | 7/2010 | Gately | |
| 2011/0167744 | A1 | 7/2011 | Whispell et al. | |
| 2011/0167750 | A1 | 7/2011 | Pervan | |
| 2012/0317909 | A1 | 12/2012 | MacKenzie | |
| 2013/0283720 | A1 | 10/2013 | Pervan et al. | |
| 2013/0312356 | A1 | 11/2013 | Foral | |
| 2014/0215945 | A1 | 8/2014 | Swanson | |
| 2014/0345226 | A1 * | 11/2014 | Southwell | E04F 13/0817 52/506.05 |

OTHER PUBLICATIONS

Vintage Woodworks, "V-Groove Board," http://www.vintagewoodworks.com/v-groove.html as printed Mar. 11, 2015 in 2 pages.

Boral TruExterior Siding and Trim, http://www.boralamerica.com/TruExterior/truexterior-siding as printed Nov. 25, 2015 in 2 pages.

* cited by examiner

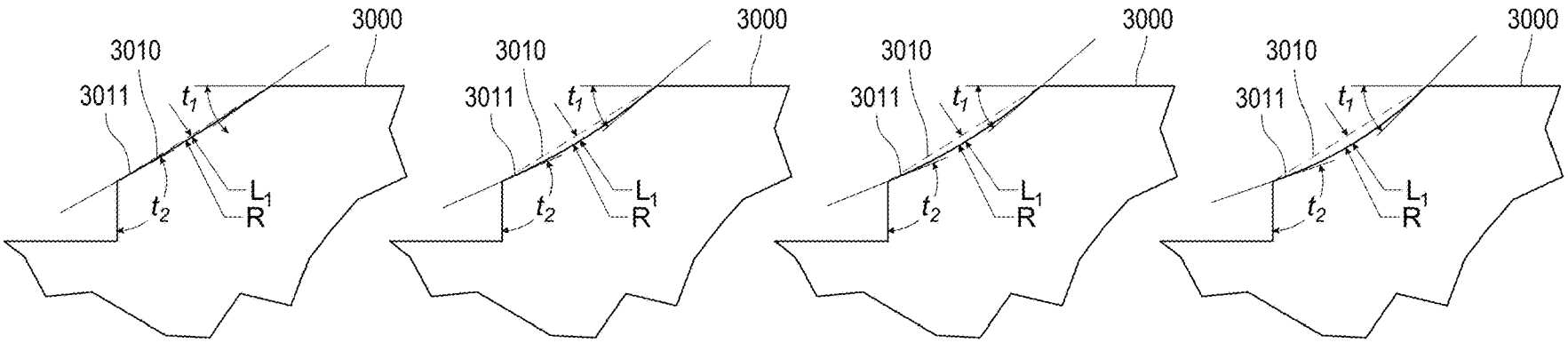
FIG. 14A
FIG. 14B
FIG. 14C
FIG. 14D
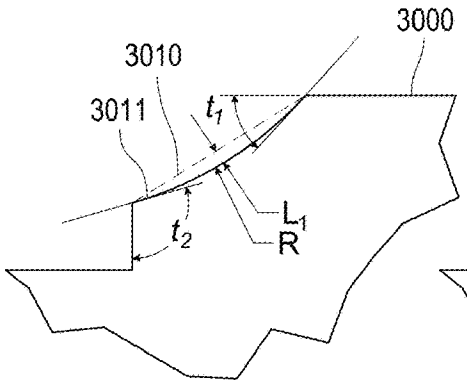
FIG. 14E
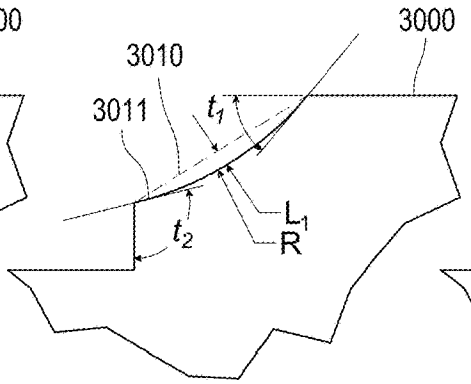
FIG. 14F
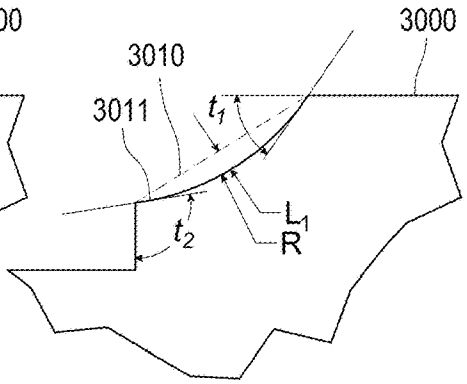
FIG. 14G

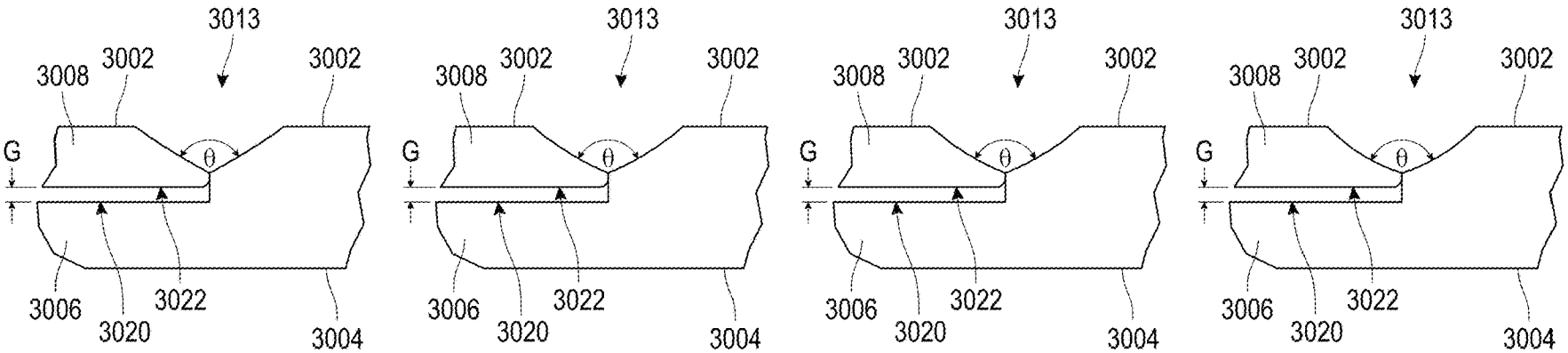
FIG. 15A
FIG. 15B
FIG. 15C
FIG. 15D
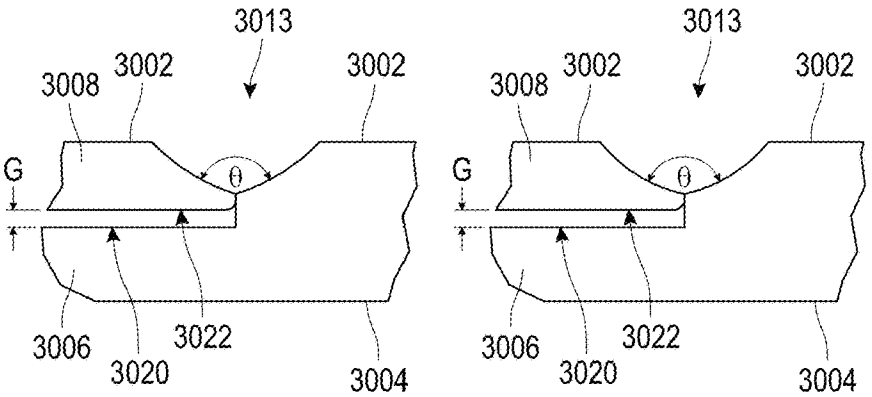
FIG. 15E
FIG. 15F
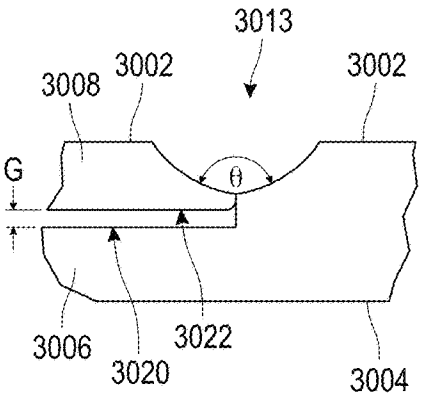
FIG. 15G

CLADDING ELEMENT

CROSS-REFERENCE TO RELATED APPLICATIONS

This application is a continuation-in-part of U.S. patent application Ser. No. 15/686,037, filed Aug. 24, 2017 and entitled CLADDING ELEMENT, which is a continuation of U.S. patent application Ser. No. 14/838,217, filed Aug. 27, 2015 and entitled CLADDING ELEMENT, which claims the benefit of U.S. Provisional Patent Application No. 62/042,758, filed Aug. 27, 2014 and entitled CLADDING ELEMENT. This application is also a continuation-in-part of U.S. patent application Ser. No. 15/686,043, filed Aug. 24, 2017 and entitled CLADDING ELEMENT, which is a divisional of U.S. patent application Ser. No. 14/838,217, filed Aug. 27, 2015 and entitled CLADDING ELEMENT, which claims the benefit of U.S. Provisional Patent Application No. 62/042,758, filed Aug. 27, 2014 and entitled CLADDING ELEMENT. Each of the above-referenced patent applications are hereby incorporated by reference in their entirety and for all purposes.

FIELD

The present disclosure relates to building elements suitable for use in construction. In particular the disclosure relates to cladding elements suitable for use in a building envelope.

The embodiments have been developed primarily for use as cladding elements and will be described hereinafter with reference to this application. However, it will be appreciated that the embodiments are not limited to this particular field of use and that the embodiments can be used in any suitable field of use known to the person skilled in the art.

BACKGROUND

Any discussion of the prior art throughout the specification should in no way be considered as an admission that such prior art is widely known or forms part of the common general knowledge in the field.

Wood cladding elements are sometimes used to protect and/or improve the aesthetic qualities of walls and other structures. However, wood can be difficult and expensive to install and can have limited durability.

SUMMARY

It is an object of the present disclosure to overcome or ameliorate at least one of the disadvantages of the prior art, or to provide a useful alternative.

In one embodiment, a cladding system comprising a plurality of cladding elements is described. The system comprises first and second cladding elements, each of the first and second cladding elements having: a front face; a rear face opposite the front face; a first mating edge between the front face and the rear face, a second mating edge between the front face and the rear face opposite the first mating edge; a first joint end between the front face and the rear face; and a second joint end between the front face and the rear face, opposite the first joint end. The first mating edge comprises: a first recessed portion having a front-facing surface set rearward from the front surface of the cladding element; a first chamfer portion extending from the rear face of the cladding element toward the front face of the cladding element and away from a second mating edge of the cladding element; a first concave arcuate planar surface extending from the front face of the cladding element toward the first recessed portion and away from the second mating edge; and a first abutment face connecting the front-facing surface of the first recessed portion with the first concave arcuate planar surface. The second mating edge comprises: a second recessed portion having a rear-facing surface set forward from the rear face of the cladding element; a second chamfer portion extending in a direction from the rear face of the cladding element toward the front face of the cladding element and toward the first mating edge; a second concave arcuate planar surface extending from the front face of the cladding element toward the recessed portion and away from the first mating edge; and a second abutment face connecting the rear-facing surface of the recessed portion with the concave arcuate planar surface. The first mating edge of the first cladding element is mated with the second mating edge of the second cladding element. At least a portion of the first chamfer portion of the first cladding element contacts at least a portion of the second chamfer portion of the second cladding element. The first concave arcuate planar surface of the first cladding element is positioned adjacent the second concave arcuate planar surface of the second cladding element to form an arcuate v-groove profile.

In some embodiments, the first concave arcuate planar surface intersects the front face at a first angle $t_1$ relative to the front face, and intersects the first abutment face at a second angle smaller than $t_1$ relative to a plane parallel to the front face. In some embodiments, the first angle $t_1$ is between approximately 32° and approximately 47.5°. In some embodiments, the first angle $t_1$ is between approximately 40° and approximately 47.5°. In some embodiments, the first concave arcuate planar surface has a radius of curvature between approximately 67.61 mm and approximately 13.84 mm. In some embodiments, the first concave arcuate planar surface has a radius of curvature between approximately 26.30 mm and approximately 13.84 mm. In some embodiments, the first concave arcuate planar surface and the second concave arcuate planar surface intersect the front face at approximately the same tangential angle. In some embodiments, the first concave arcuate planar surface and the second concave arcuate planar surface have approximately the same radius of curvature. In some embodiments, the first and second cladding elements have a thickness of between approximately 11 mm and approximately 17 mm. In some embodiments, the arcuate v-groove profile extends along an entire length of each of the first and second cladding elements with no visibly perceptible variations in a width of the v-groove profile. In some embodiments, the first and second cladding elements comprise fibre cement.

In another embodiment, a cladding element comprises: a front face; a rear face opposite the front face; a first mating edge between the front face and the rear face; a second mating edge between the front face and the rear face, opposite the first mating edge; a first joint end between the front face and the rear face; and a second joint end between the front face and the rear face, opposite the first joint end. The first mating edge comprises: a first recessed portion having a front-facing surface set rearward from the front surface of the cladding element; a first chamfer portion extending from the rear face of the cladding element toward the front face of the cladding element and away from a second mating edge of the cladding element; a first concave arcuate planar surface extending from the front face of the cladding element toward the first recessed portion and away from the second mating edge; and a first abutment face connecting the front-facing surface of the first recessed portion with the first concave arcuate planar surface. The second mating edge comprises: a second recessed portion having a rear-facing surface set forward from the rear face of the cladding element; a second chamfer portion extending in a direction from the rear face of the cladding element toward the front face of the cladding element and toward the first mating edge; a second concave arcuate planar surface extending from the front face of the cladding element toward the recessed portion and away from the first mating edge; and a second abutment face connecting the rear-facing surface of the recessed portion with the concave arcuate planar surface.

In some embodiments, the first concave arcuate planar surface intersects the front face at a first angle $t_1$ relative to the front face, and intersects the first abutment face at a second angle smaller than $t_1$ relative to a plane parallel to the front face. In some embodiments, the first angle $t_1$ is between approximately 32° and approximately 47.5°. In some embodiments, the first angle $t_1$ is between approximately 40° and approximately 47.5°. In some embodiments, the first concave arcuate planar surface has a radius of curvature between approximately 67.61 mm and approximately 13.84 mm. In some embodiments, the first concave arcuate planar surface has a radius of curvature between approximately 26.30 mm and approximately 13.84 mm. In some embodiments, the first concave arcuate planar surface and the second concave arcuate planar surface intersect the front face at approximately the same tangential angle. In some embodiments, the first concave arcuate planar surface and the second concave arcuate planar surface have approximately the same radius of curvature. In some embodiments, the first and second cladding elements comprise fibre cement.

In a further embodiment, a cladding system comprises a plurality of cladding elements is described. The system comprises: a first cladding element having a front face and a first mating edge comprising a first concave arcuate planar surface intersecting the front face of the first cladding element along a first edge of the front face of the first cladding element; and a second cladding element having a front face and a second mating edge comprising a second concave arcuate planar surface intersecting the front face of the second cladding element along a second edge of the front face of the second cladding element. The first concave arcuate planar surface and the second concave arcuate planar surface together form an arcuate v-groove extending along a length of the first and second cladding elements between the front face of the first cladding element and the front face of the second cladding element.

In some embodiments, the first concave arcuate planar surface intersects the front face of the first cladding element at a first angle $t_1$ relative to the front face of the first cladding element, and the second concave arcuate planar surface intersects the front face of the second cladding element at the first angle $t_1$. In some embodiments, the first angle $t_1$ is between approximately 32° and approximately 47.5°. In some embodiments, the first angle $t_1$ is between approximately 40° and approximately 47.5°. In some embodiments, the first concave arcuate planar surface has a radius of curvature between approximately 67.61 mm and approximately 13.84 mm. In some embodiments, the first concave arcuate planar surface has a radius of curvature between approximately 26.30 mm and approximately 13.84 mm. In some embodiments, the first and second cladding elements have a thickness of between approximately 11 mm and approximately 17 mm. In some embodiments, the arcuate v-groove extends along the entire length of each of the first and second cladding elements with no visibly perceptible variations in a width of the v-groove. In some embodiments, the first and second cladding elements comprise fibre cement. In some embodiments, the first and second cladding elements have a thickness between approximately 11 mm and approximately 16 mm.

BRIEF DESCRIPTION OF THE DRAWINGS

The embodiments will now be described more particularly with reference to the accompanying drawings, which show by way of example only cladding elements of the disclosure.

FIGS. 14A to 14G are enlarged cross-sectional side views of further embodiments of the bevel area of a cladding element.

FIGS. 15A to 15G are enlarged cross-sectional side views of the further embodiments of the bevel area of FIGS. 14A to 14G, wherein two cladding elements are in an abutment arrangement.

DETAILED DESCRIPTION

Figure 1B:
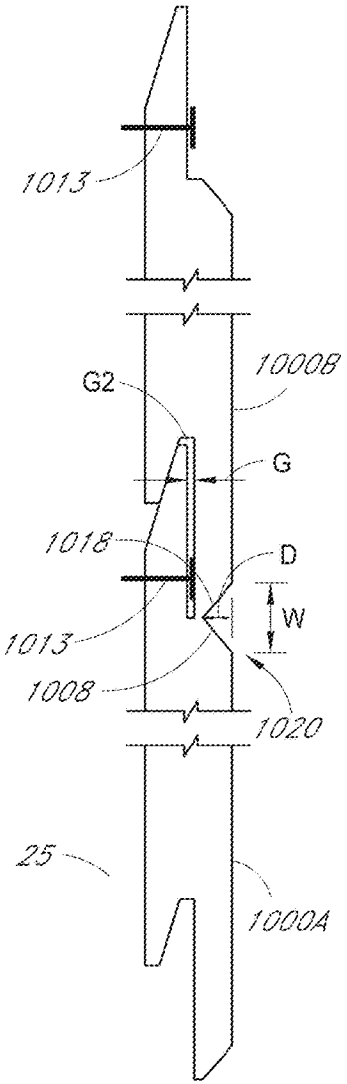
FIG. 1B is a cross-sectional view of a cladding system having two mated cladding elements of FIG. 1A.

Although making and using various embodiments are discussed in detail below, it should be appreciated that the embodiments described provide inventive concepts that may be embodied in a variety of contexts. The embodiments discussed herein are merely illustrative of ways to make and use the disclosed devices, systems and methods and do not limit the scope of the disclosure.

In the description which follows like parts may be marked throughout the specification and drawing with the same reference numerals, respectively. The drawing figures are not necessarily to scale and certain features may be shown exaggerated in scale or in somewhat generalized or schematic form in the interest of clarity and conciseness.

Generally described, the present disclosure provides for relatively thin cladding elements that provide a desirable aesthetic appearance and retain suitable wind load resistance characteristics. In one example, cladding elements having a v-groove design include one or more chamfered or beveled edges along a front face. When the cladding elements are made relatively thin, a relatively shallow chamfer angle may be needed to retain sufficient strength and/or wind load characteristics. However, the shallow chamfer angle may result in undesirably large variation in the apparent width of the v-groove formed by adjacent cladding elements, caused by relatively minor variations in the thickness of the cladding elements. In some embodiments of the present technology, an arcuate surface is provided rather than a straight chamfer angle. The arcuate surface may be described by at least a tangential angle formed at the interface between the arcuate surface and the front face of the cladding element, and a radius of curvature of the arcuate surface. As will be described in greater detail, the arcuate surfaces described herein may improve the aesthetic appearance of the cladding elements by retaining the full v-groove thickness of straight chamfered cladding elements, while increasing the tangential angle between the chamfer and the front face of the cladding element, thus reducing the apparent variation in v-groove thickness to a visually imperceptible level.

There are a number of different methods used to install cladding elements in series on a building substrate, each method dependent on the type of cladding material used, the wind load requirements and the desired aesthetic effect.

There are also a number of options for aesthetics at the interface between two adjacent cladding elements in a series. The interface between two adjacent cladding elements are commonly profiled to have either a 'v' groove channel, a square channel or a rabbet profile. The rabbet profile was developed by the wood industry and is more commonly referred to as ship-lap. The rabbet profile appears as a step shaped recess or rebate between the two adjacent cladding elements.

There are substantially two main methods used when installing plank cladding elements namely lap side cladding or flat wall cladding.

Lap side cladding is used to describe cladding elements that are installed on a structural support such that there is an overlap between consecutive cladding elements, whereby the primary visible external surfaces of consecutive cladding elements are parallel but not coplanar.

In contrast, flat wall cladding is used to describe cladding elements that are installed on a structural support such that there is no overlap between consecutive cladding elements, whereby the primary visible external surfaces of consecutive cladding elements are parallel and coplanar.

There are a number of different installation methods used to achieve a flat wall cladding aesthetic, for example, stacking rabbet/ship-lap, tongue and groove, and clip. In each of the stacking rabbet/ship-lap and tongue and groove installation methods, the cladding elements are profiled such that the bottom edge of a first cladding element is able to overlap the top edge of a second cladding element when the second cladding element is positioned below the first cladding element whilst ensuring that the primary visible external surfaces of consecutive first and second cladding elements are parallel and coplanar. The thickness and configuration of the cladding elements enable a cladding system using said cladding elements and standard nailing methods to achieve a desired wind load requirement.

The clip installation method can take a number of forms but is characterized by a common or specialized fastener (clip) that engages the cladding elements positioned both above and below the fastener. The primary benefits of using a specialized fastener/clip to secure consecutive cladding elements is that clip can spread fastening load over a greater area than for example a traditional nail fastener. Typically, fibre cement cladding elements used in the clip installation method are approximately 12 mm thick. A clip installation method enables an installer to clad a building wall or other structure with thinner cladding elements and achieve a flat wall aesthetic that has similar and possibly better wind load performance over cladding elements installed without the specialized fastener.

A thinner board is typically lighter than an equivalent 16 mm board. Accordingly it is easier for an end user to handle this board. It is therefore desirable to provide a fibre cement cladding element that is as thin as or thinner than fibre cement cladding elements typically used in clip installation methods, that can be installed in a cladding system without a clip or specialized fastener whilst achieving the same or better wind loading.

Cladding elements can be assembled to produce cladding systems (e.g., wall portions). These cladding systems can be installed on an exterior or interior surface of a wall to provide aesthetic improvement, improved weather resistance, improved thermal efficiency, improved structural stability, and/or many other improvements to an existing wall. For example, the cladding systems disclosed herein can be installed on substructure such as a wooden frame or any other suitable wall structure which could be an interior or exterior wall structure.

Figure 1A:
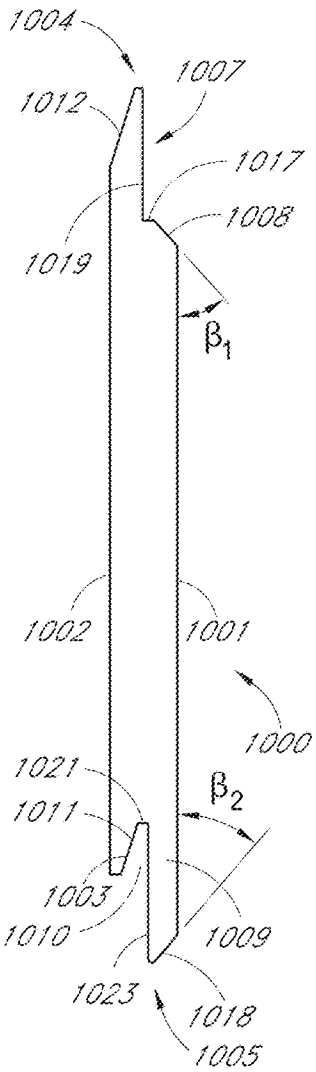
FIG. 1A is a cross-sectional view of an embodiment of a cladding element.

FIGS. 1A and 1B illustrate an embodiment of a cladding element 1000 and of a cladding system, respectively. The cladding element 1000 includes a front face 1001 (e.g., a face extending outward from a wall when the cladding system is assembled). As illustrated, the cladding element 1000 includes a rear face 1002 opposite the front face 1001.

The cladding element 1000 includes a first profiled edge 1004 extending between the front and rear faces 1001, 1002. The cladding element 1000 can include a second profiled edge 1005 extending between the front and rear faces 1001, 1002 on a side of the element 1000 opposite the first profiled edge 1004. The first profiled edge 1004 of a first element 1000A (FIG. 1B) can be configured to mate with the second profiled edge 1005 of a second cladding element 1000B.

The first profiled edge (e.g., mating edge) 1004 of the cladding element 1000 can include a recessed portion 1007. The recessed portion 1007 can include a front face 1019 substantially parallel to and positioned rearward of the front face 1001 of the cladding element 1000. The first profiled edge 1004 can include a first angled portion 1008 extending from the front face 1001 of the cladding element 1000 toward the rear face 1002 of the element 1000 away from the second profiled edge 1005 of the element 1000. The first profiled edge 1004 can include a second angled portion 1012 extending from the rear face 1002 of the element 1000 toward the front face 1001 of the element 1000 and away from the second profiled edge 1005 of the element 1000.

The second profiled edge 1005 of the cladding element 1000 can include a first angled portion 1018 extending away from the front face 1001 of the element 1000 toward the rear face 1002 and away from the first profiled edge 1004 of the cladding element 1000. The second profiled edge 1005 of the cladding element 1000 can include a recessed portion 1010. The recessed portion 1010 can include a rear face 1023 substantially parallel to and positioned forward of the rear face 1002 of the cladding element 1000. The portion of the second profiled edge 1005 between the recess 1010 and the front surface 1001 of the cladding element 1000 can include an overlap portion 1009. The second profiled edge 1005 can include second angled portion 1003 having a sloped surface 1011 extending in a direction from the rear surface 1002 toward the front face 1001 and toward the first profiled edge 1004 of the cladding element 1000.

In some embodiments, the recessed portion 1007 of the includes an offset portion 1017 between the angled portion 1008 and the front face 1019 of the recessed portion 1007, as measured substantially perpendicular to the first face 1001 of the cladding element 1000. The overlap portion 1009 can include an abutment face 1021 between the angled portion 1018 and a rear face 1023 of the overlap portion 1009 as measured substantially perpendicular to the second face 1002 (e.g., the rear face) of the cladding element 1000.

As illustrated in the cladding system of FIG. 1B, the angled portion 1018 of a first cladding element 1000*a* can form a "V" groove 1020 with the angled portion 1008 of the recessed portion 1007 of a second cladding element 1000*b* when the first and second cladding elements 1000*a*, 1000*b* are mated with each other. The V-groove 1020 configuration can simulate V-groove configurations sometimes used with wood cladding elements. Use of the V-groove shape can provide a shadowed, seamed look between the adjacent cladding elements in the system while reducing the likelihood that dirt, water, or other environmental hazards collect in the groove. For example, as compared to a system wherein the cladding elements include surface 1018 perpendicular to the front face 1001 of the element, the V-groove shape can permit more rain access to the groove to wash out debris, while the sloped shape of the V-groove leads the rainwater along the sloped surface 1008 and out of the groove 1020.

The overall shape of the groove 1020 can be altered through adjustment of certain parameters. For example, the angles (31, (32 of the angled portions 1008, 1018 as measured from the first surface 1001 (e.g. the front face) can be varied. In some instances, the angle β1 of angled portion 1008 is the same as the angle β2 of angled portion 1018. In some cases, the angle β1 of angled portion 1008 is greater than or less than the angle β2 of angled portion 1018. Increasing the value of one or more of the angles β1, β2 while maintaining the depth D of the groove 1020 can decrease the width W of the groove 1020. Many variations are possible.

As illustrated in FIG. 1B, the depth D of the groove 1020 in a cladding system can be adjusted by adjusting the depth (e.g., as measured from the first surface 1001) to which the angled surfaces 1008, 1018 extend. Variance of the depth D of the groove 1020 can vary the visual and/or environmental characteristics of the assembled cladding elements 1000A, 1000B. For example, increasing the depth D of the groove 1020 can increase the light contrast between the front faces 1001 of the elements 1000A, 1000B and the groove 1020 by creating a darker shadow within the groove 1020. In some embodiments, reducing the depth D of the groove 1020 and/or reducing the angle β1 of the angled portion 1008 can decrease accumulation of particulates (e.g., sand, dust, etc.). For example, reducing the angle β1 provides a steeper slope off of which particulates will fall under the influence of gravity prior to accumulating on the angled portion 1008. In some cases, reducing the depth D increases the access of rain and/or other liquid to the full surface of the groove 1020 to wash away particulates.

In some cases, a gap G can remain between the rear face 1023 of the overlap portion 1009 of a first cladding element 1000*a* and the front face 1019 of the recessed portion 1007 of a second cladding element 1000*b* when the first and second cladding elements 1000*a*, 1000*b* are connected to each other. The gap G can be between 0.01 inches and 0.1 inches when measured perpendicular to the first face 1001 of first cladding element 1000*a*. In some embodiments, the gap G is approximately 0.06 inches measured substantially perpendicular to the first face 1001 of the first cladding element 1000*a*. Many variations are possible. A second gap G2 in the cladding system can be formed between the abutment face 1021 of the second cladding element 1000*b* and the tip of the first profiled edge 1004 of the first cladding element 1000*a*. The second gap G2 can be connected to and/or continuous with the gap G.

The gaps G and/or G2 can be sized and/or shaped to accommodate adhesives, sealants, insulators, and/or other materials. For example, an adhesive material can be applied to the front face 1019 of the recessed portion of the first cladding element 1000B and/or to the rear face 1023 of the overlap portion 1009 of the second cladding element 1000A before the first and second cladding elements 1000A, 1000B are mated together. Positioning materials in the gap G between the front face 1019 of the recessed portion of the first cladding element 1000B and the rear face 1023 of the overlap portion 1009 of the second cladding element 1000A can increase the weather resistance of the assembled cladding elements 1000A, 1000B by reducing the likelihood that moisture (e.g., rain, condensation, etc.) will pass between the groove 1020 and the second surfaces 1002 of the cladding elements 1000A, 1000B. In some cases, sealant or other materials can be inserted into the second gap G2 without insertion of sealant into the other gap G.

In some embodiments, the interface between the first profiled side edge 1004 of the first cladding element 1000A and the second profiled side edge 1005 of the second cladding element 1000B can provide a tortuous (e.g., tedious, serpentine, labyrinthine) path through which moisture would be required to travel to reach the second surface 1002 of the cladding elements 1000A, 1000B from the groove 1020. For example, the interface can include a plurality of turns (e.g., 3 turns, 4 turns, 5 turns, etc.) through which the moisture would be required to pass. In some cases, the tortuous interface between the two cladding elements 1000A, 1000B would force the moisture to switch direction one or more time (e.g., vertically and/or laterally) when traveling from the groove 1020 to the second surfaces 1002.

Figure 1C:
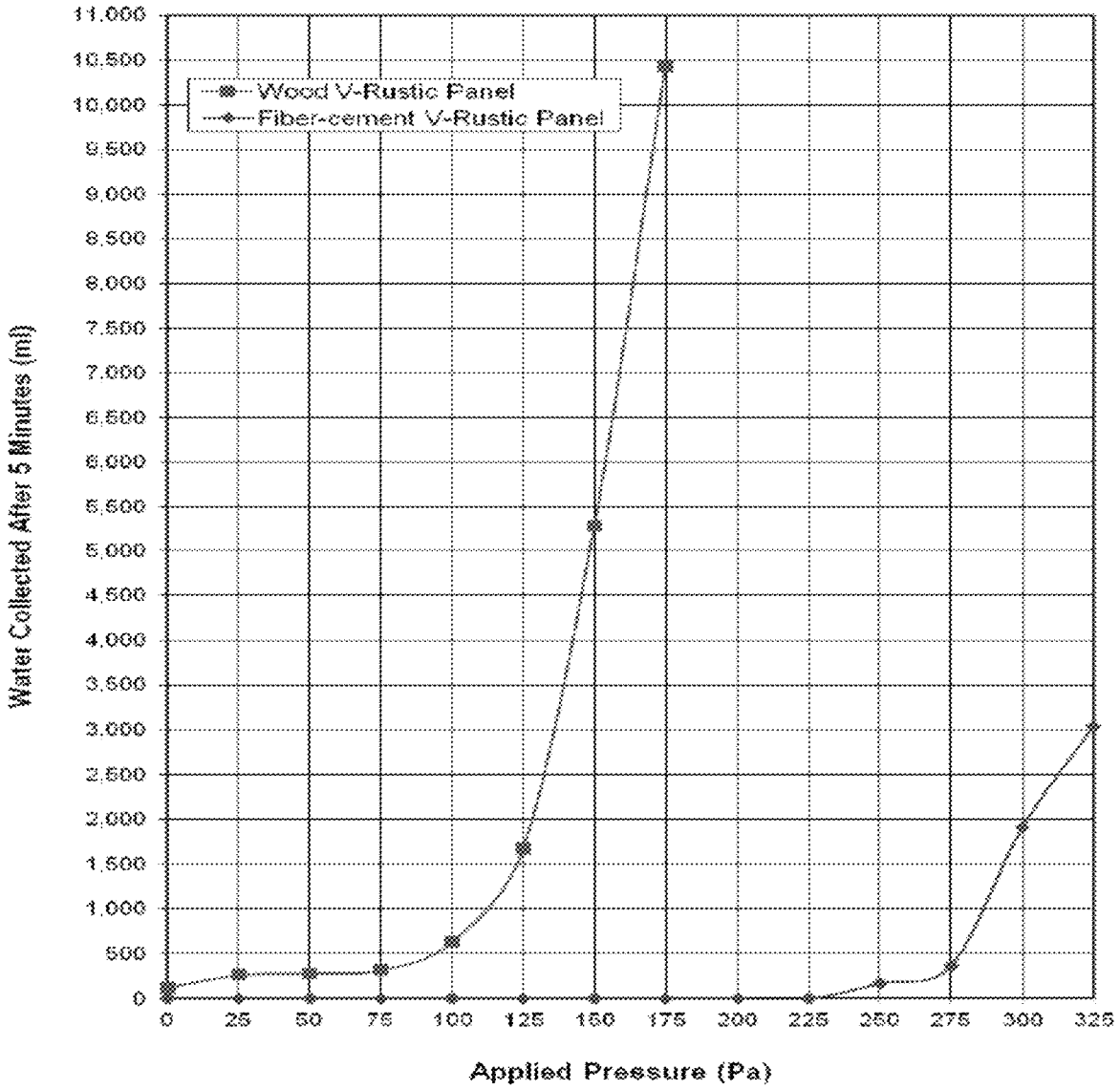
FIG. 1C is a graph illustrating the results of an ASTM E 331 test performed on the cladding system of FIG. 1B.

In some embodiments, the interface between the first profiled side edge 1004 of the first cladding element 1000*a* constructed from fibre cement and the second profiled side edge 1005 of the second cladding element 1000*b* constructed from fibre cement can have significantly reduced water leakage (e.g., water through a thickness of the assembled elements 1000*a*, 1000*b*) as compared to two cladding elements constructed from wood. Such water-resisting characteristics are immediately apparent when conducting an ASTM E 331 test. The ASTM E 331 test comprises constructing a cladding element system (e.g., a cladding element wall) comprised of multiple mated cladding elements. In the present case, a 4' by 8' cladding system control specimen consisting of V-Groove wood elements was constructed, as was a 4' by 8' cladding system test specimen consisting of V-Groove fibre cement elements (e.g., elements 1000, described above). The respective walls were subject to incrementally-increased water pressure until leakage was detected on a back side of the wall. Water was applied for 5 minutes at each pressure increment. When water was detected on the back side of the wall, the pressure was maintained for 5 minutes and the leaked water was collected for measurement. When subject to the ASTM E 331 test, the fibre cement elements resisted water penetration for water pressures up to at least 225 psi, whereas wood elements having substantially the same geometric shapes as the elements 1000*a*, 1000*b*, permitted water penetration at 0 psi. In some cases, the water penetration through the fibre cement elements was less at 325 psi than the water penetration through the wood elements at 150 psi. Results of the test are reflected in FIG. 1C.

As illustrated in FIG. 1B, the cladding element 1000 may be installed on a wall 25 (e.g., an exterior wall) of a building by inserting one or more fasteners 1013 through the front face 1019 of the recessed portion 1007. The fasteners 1013 can be positioned such that the overlap portion 1009 of a second cladding element 1000 covers or hides the fasteners 1013 from view when the second cladding element 1000 is mated with the first cladding element. Utilizing such a fastening process (e.g., "blind" nailing) can improve the aesthetics of the assembled cladding elements 1000. In some cases, blind nailing can increase the durability of the assembled cladding elements 1000 by, for example, reducing exposure of the fasteners and their respective holes to moisture and other outside elements. In some applications, blind nailing can reduce the costs of installing the cladding elements 1000 on a wall by reducing the number of fasteners required to install the cladding elements 1000 and thereby reducing the amount of time required to install the cladding elements 1000. For example, traditional wood cladding elements often require the use of fasteners on both the top and bottom sides of the cladding elements. The cladding elements 1000 of the present disclosure, however, can be installed without the use of fasteners on the bottom side (e.g., the second profiled edge 1005).

In some embodiments, the use of cladding elements 1000 to cover a wall (e.g., to assembly a cladding system) can reduce the overall installation time of the cladding elements 1000 (e.g., as compared to the time required to install traditional wood cladding elements). For example, an installer may use a level or other tool to confirm the alignment of the first-installed cladding element 1000 (e.g., the bottom cladding element) when installing the cladding elements 1000. Subsequent cladding elements 1000 can be installed without the use of an alignment tool, as the mating of profiled edges 1004, 1005 of adjacent cladding elements align the subsequent cladding elements 1000 with the first-installed cladding element 1000. The self-alignment of the subsequent cladding elements 1000 can reduce the overall installation time of the cladding elements 1000 by 10-20%. In some cases, the self-alignment of the cladding elements 1000 can increase installation efficiency by over 25%. For example, on average, the self-alignment of the cladding elements 1000 can reduce the installation time to under two minutes. In some cases, the average installation time per cladding element can be approximately 100 seconds.

The shiplap-type labyrinthine connection between the first and second profiled edges 1004, 1005 of the cladding elements 1000 can facilitate either vertical installation (e.g., the length of each cladding element 1000 extends vertically) or horizontal installation (e.g., the length of each cladding element 1000 extends horizontally) of the cladding elements 1000 onto the wall of a structure. For example, as explained above, the labyrinthine connection between the first and second profiled edges 1004, 1005 can reduce the likelihood that moisture would pass from the grooves 1020 to the rear faces 1002 of the cladding elements 1000.

In some embodiments, the shiplap-type labyrinthine connection between the first and second profiled edges 1004, 1005 of the cladding elements 1000 in a cladding system can increase the overall wind resistance of the installed cladding elements. For example, the labyrinthine engagement between the cladding elements 1000 can reduce the amount of wind access between the cladding elements 1000 and the wall or other structure onto which the cladding elements 1000 are installed. In some cases, the labyrinthine engagement between the cladding elements 1000 can increase the wind resistance of the installed cladding elements by over 100% as compared to the wind resistance of plank cladding elements. In some cases, the cladding elements 1000 can withstand wind-induced loads of over 85 pounds per square foot. Reduction of wind access to a rear side of the cladding elements 1000 can reduce pressure build up between the cladding elements 1000 in a cladding system and the wall onto which they are installed.

Figure 1D:
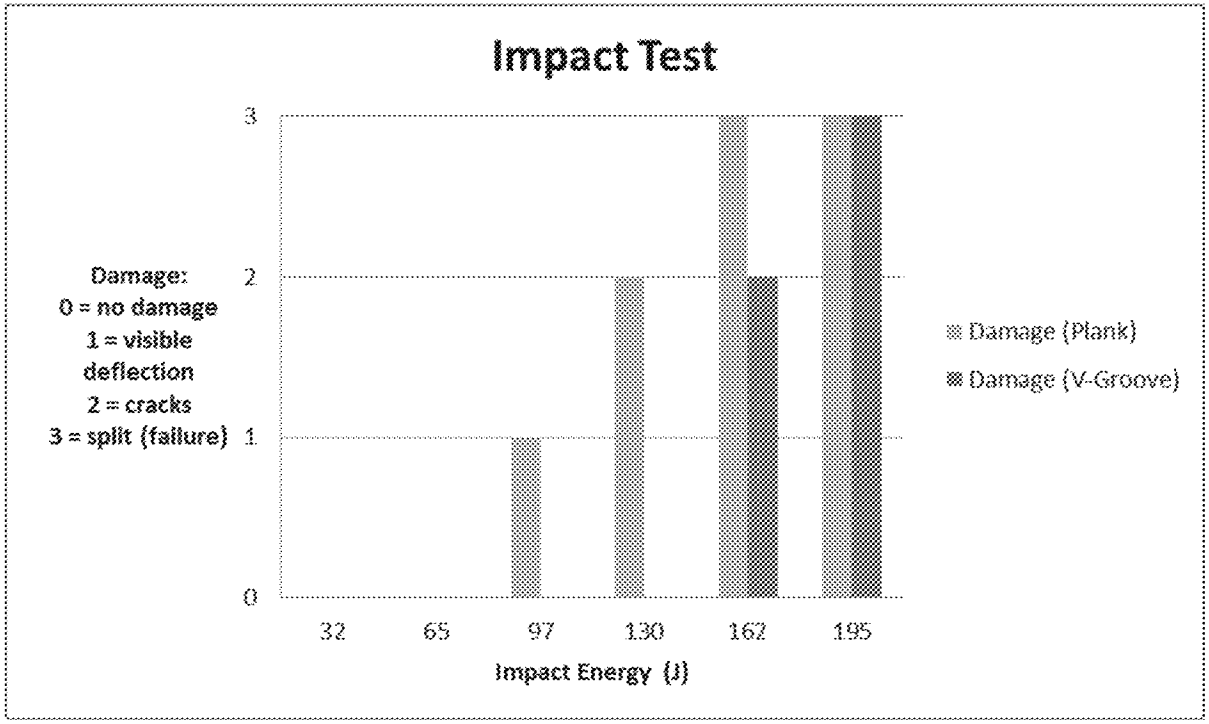
FIG. 1D is a graph illustrating the results of an impact test performed on the cladding system of FIG. 1B.

Use of cladding elements 1000 can have a significant impact on the durability of a wall (e.g., cladding system). Such impact has been proven via testing of impact resistance on a test cladding system specimen 6' by 8' wall comprising fibre cement cladding elements 1000. The control cladding system specimen for the test was a 6' by 8' wall of fibre cement planks. Both the test specimen and the control specimen were subject to impacts of incrementally-increasing energy. The test results indicate that walls (e.g., cladding systems) constructed from cladding elements 1000 having the shiplap-type labyrinthine connections can realize an increased impact resistance of over 20% as compared to plank walls. In some cases, the cladding elements 1000 are capable of withstanding over 130 Joules of energy before cracking, as compared to 97 Joules for a plank wall. In some embodiments, the cladding elements 1000 are capable of withstanding over 160 Joules of energy before splitting, as compared to 130 Joules for a plank wall. In some cases, the shiplap-type labyrinthine connection of the cladding elements 1000 (e.g., the overlap realized in the labyrinthine connections) can facilitate energy distribution among adjacent cladding elements in a more efficient manner than is the case with plank walls. The use of joints to connect adjacent cladding elements, as described below, can further increase energy distribution and/or impact resistance of the cladding elements. Results of the testing are shown in FIG. 1D.

Figure 2:
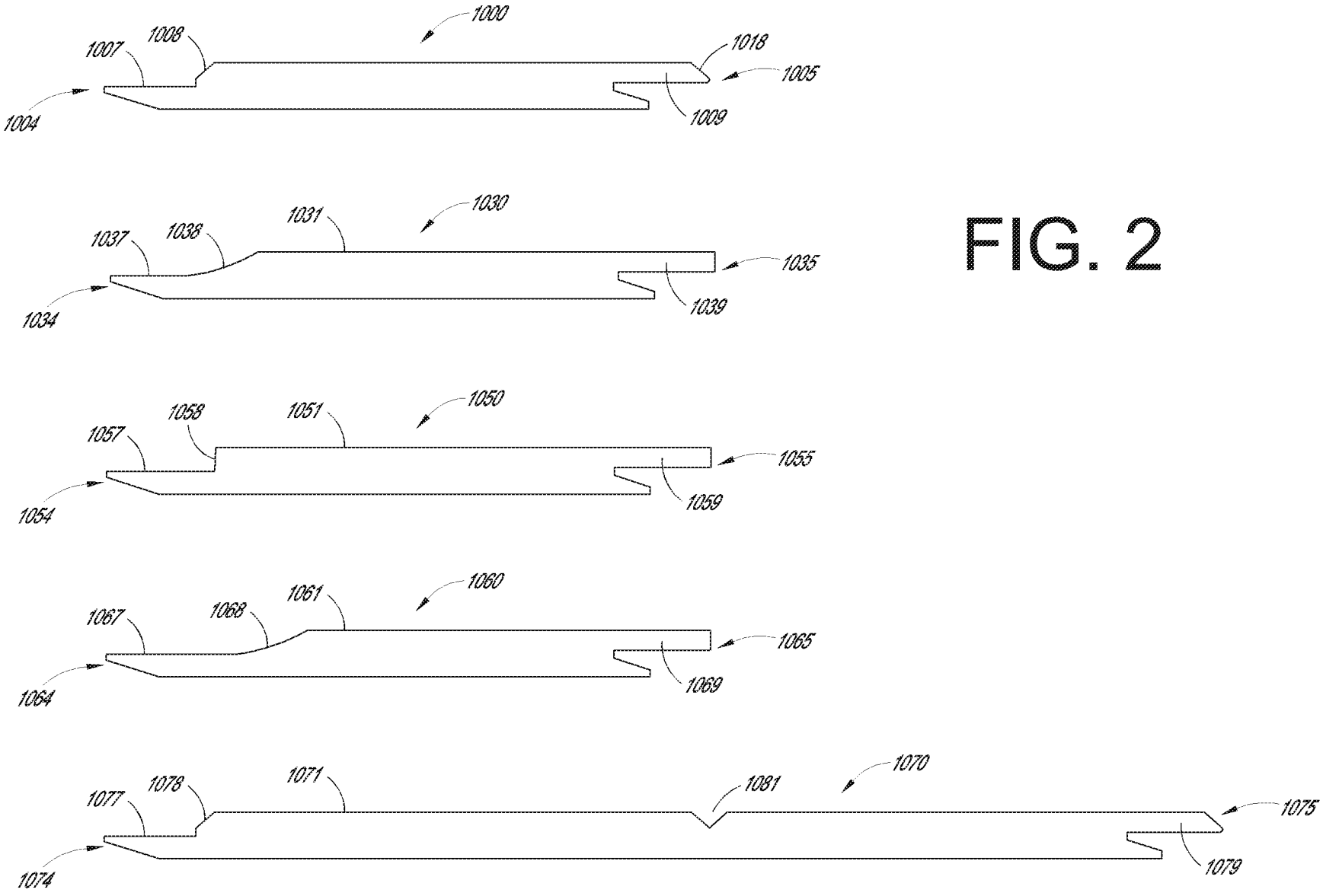
FIG. 2 is a cross-sectional view of a plurality of embodiments of cladding elements.

FIG. 2 illustrates additional embodiments of cladding elements 1030, 1040, 1050, 1060, and 1070. For example, in some embodiments, a cladding element 1030 can have a transition portion 1038 between the first surface 1031 and the front recessed surface 1037. The transition portion 1038 can have a concave shape. Such a configuration is sometimes referred to as cove shiplap. Additionally, a square channel configuration can be utilized, wherein a transition portion 1058 of the cladding element 1050 is substantially planar and substantially perpendicular (e.g., within 5 degrees of perpendicular) to one or both of the front recessed surface 1057 and the first surface 1051. In some cases, the transition portion 1058 of a first cladding element 1050 is spaced from second profiled side edge 1055 of a second cladding element 1050 when the second profiled side edge 1055 of the second cladding element 1050 is mated with the first profiled side edge 1054 of the first cladding element 1050. In some cases, a cladding element 1060 can have a wide cove configuration wherein the concave transition portion 1068 of a first cladding element 1060 is spaced from second profiled side edge 1065 of a second cladding element 1060 when the second profiled side edge 1065 of the second cladding element 1060 is mated with the first profiled side edge 1064 of the first cladding element 1060.

In some embodiments, a cladding element 1070 can include one or more channel features 1081 in the first surface 1071 of the cladding element 1070. The channel features 1081 can have the same shape (e.g., V groove, cove, wide cove, square channel, etc.) as the shapes of the grooves formed between mated cladding elements.

Cladding elements may be installed in cladding systems in conjunction with flashing strips, caulk, and/or other weatherproofing materials to reduce moisture transfer to the structure on which the cladding elements are installed. In some cases, it may be advantageous to provide weatherproofing structure on the cladding elements themselves to reduce or eliminate the need for additional weatherproofing materials and/or waterproofing installation steps. For example, the cladding elements may include one or more joint features configured to facilitate drainage of moisture from the assembled/installed cladding elements away from the structure on which the cladding elements are installed. The joint features can be configured to facilitate moisture drainage from the cladding elements as the cladding elements shrink and/or expand after installation (e.g., due to temperature change, evaporation, chemical processes, etc.). In some embodiments, the joint features create a tortuous and/or labyrinthine passage between a front side of the cladding elements and a back side of the elements, thereby reducing the amount of moisture passage between the front side of the cladding elements and the back side of the cladding elements when the cladding elements are installed on a wall or other structure. In some cases, cladding elements which include joint features are capable of being installed both vertically (e.g., having joint features on top and bottom sides of the cladding elements) and horizontally (e.g., having joint features on lateral sides of the cladding elements), depending on the application. Examples of such joint features are described below.

FIGS. 3A-3D illustrate an embodiment of a cladding element 2000 which can include any of the profiled edge mating features described above with respect to FIGS. 1A-2. For example, the first mating edge 2006 of the cladding element 2000 can have a similar or identical profile to any of the first profiled edges of the cladding elements described above (see, e.g., FIG. 3B). Additionally, the second mating edge 2008 of the cladding element 2000 can be configured to mate with the first mating edge 2006 of another cladding element 2000 in any manner described above.

Figure 3A:
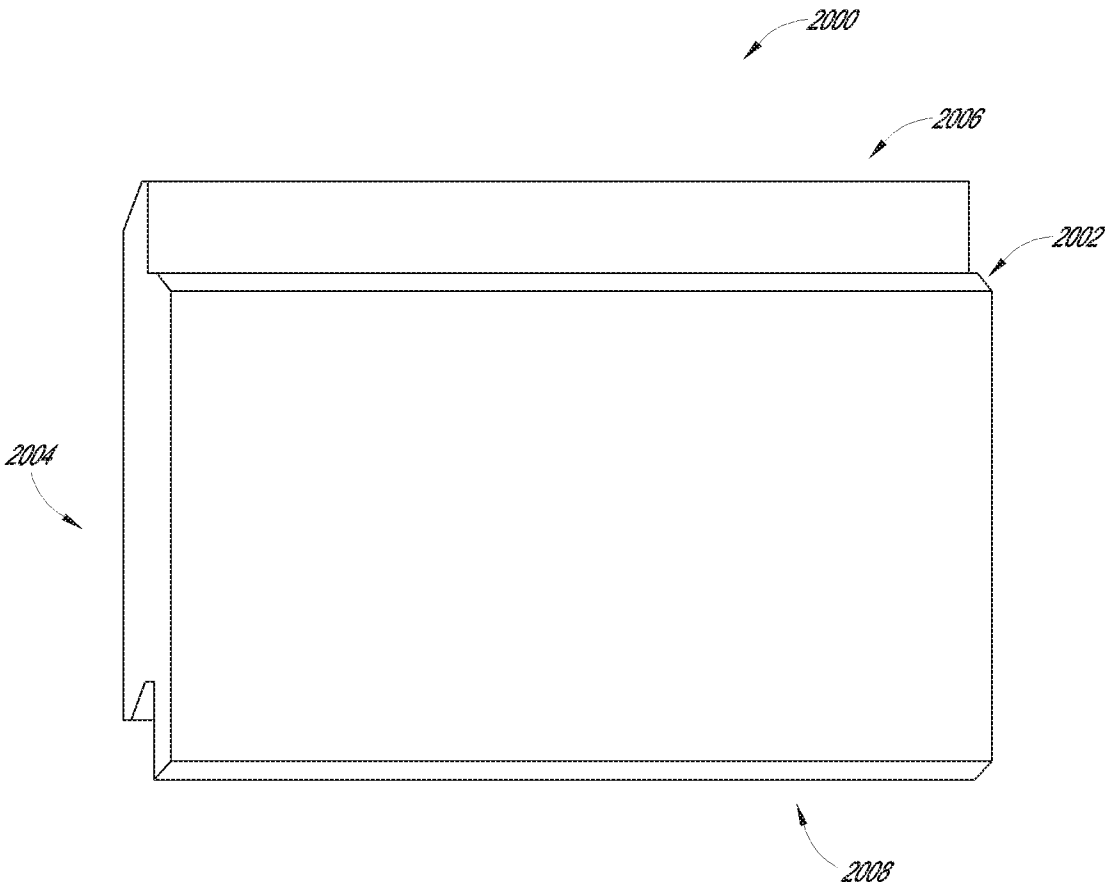
FIG. 3A is a top view of another embodiment of a cladding element.
Figure 3B:
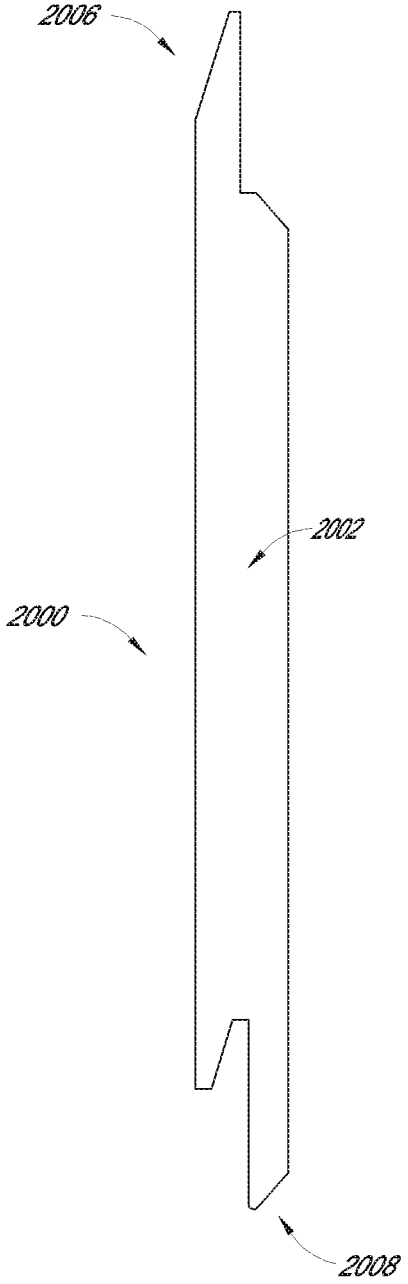
FIG. 3B is a left side view of the cladding element of FIG. 3A.

As illustrated in FIG. 3A, the cladding element 2000 is bound on one end by a first joint edge 2002. The cladding element 2000 includes a second joint edge 2004. In some embodiments, the second joint edge 2004 is distanced from and/or positioned opposite the first joint edge 2002. The first and second joint edges 2002, 2004 can be sized and/or shaped to couple with the first or second joint edges 2002, 2004 of an adjacent cladding element.

Figure 3C:
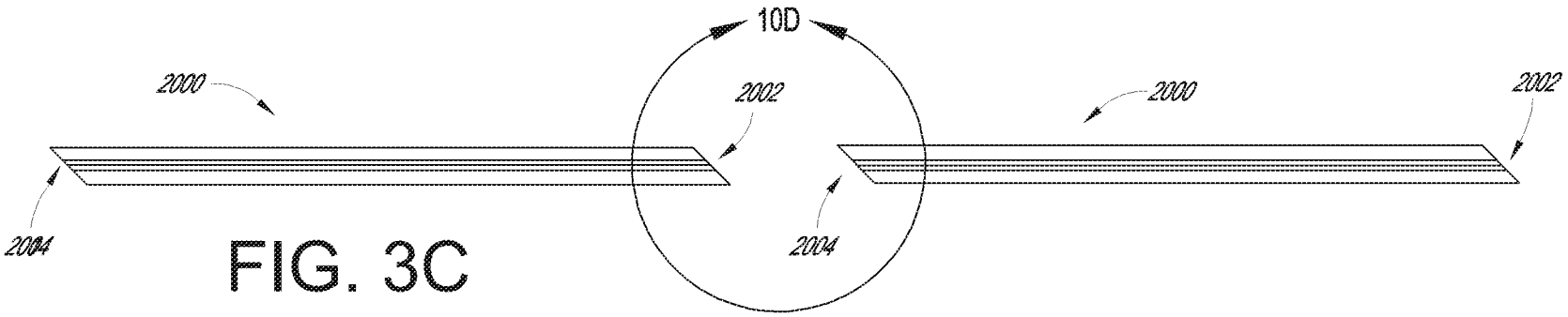
FIG. 3C is a bottom view of two cladding elements of FIG. 3A.
Figure 3D:
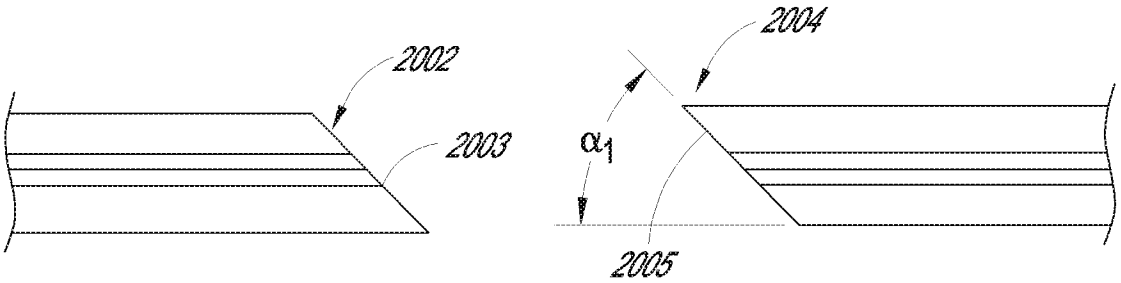
FIG. 3D is a close up bottom view of the joint edges of two cladding elements of FIG. 3A.
Figure 4A:
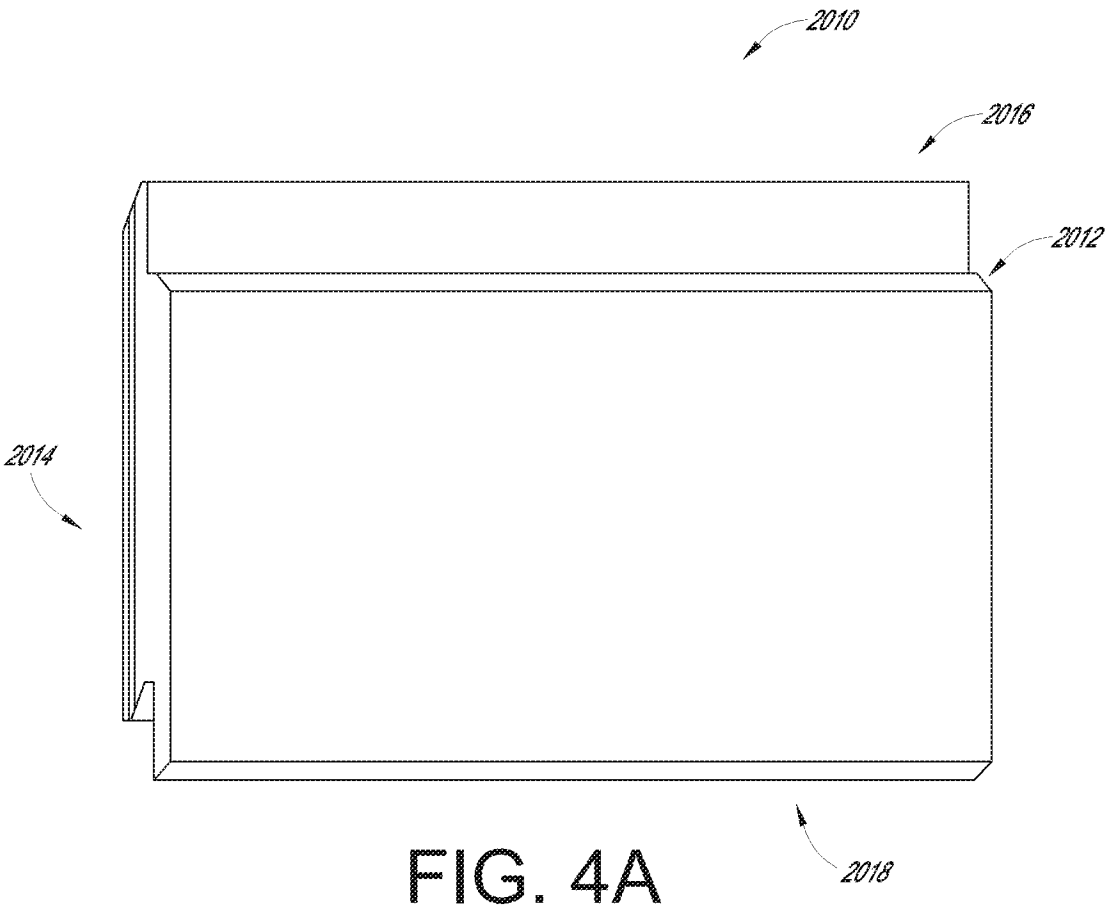
FIG. 4A is a top view of another embodiment of a cladding element.
Figure 4B:
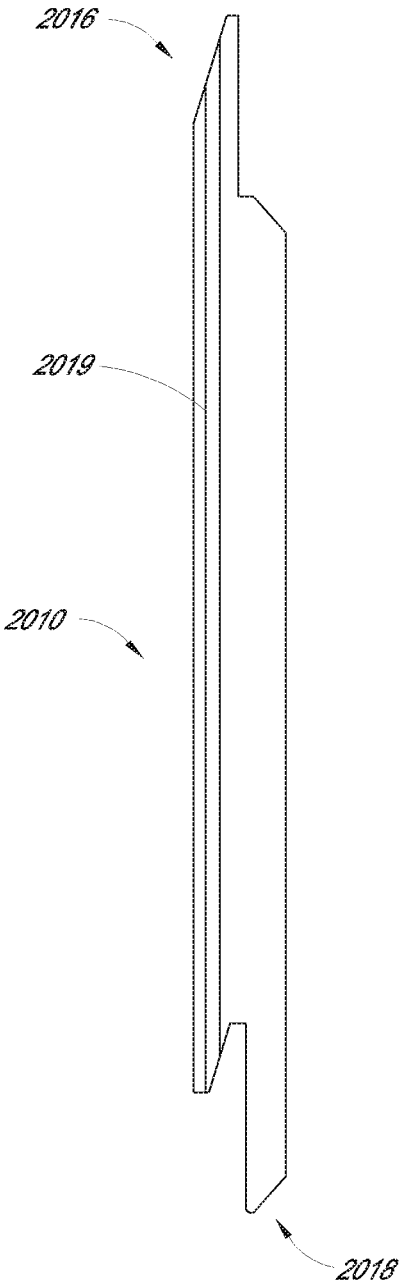
FIG. 4B is a left side view of the cladding element of FIG. 4A.
Figure 4C:
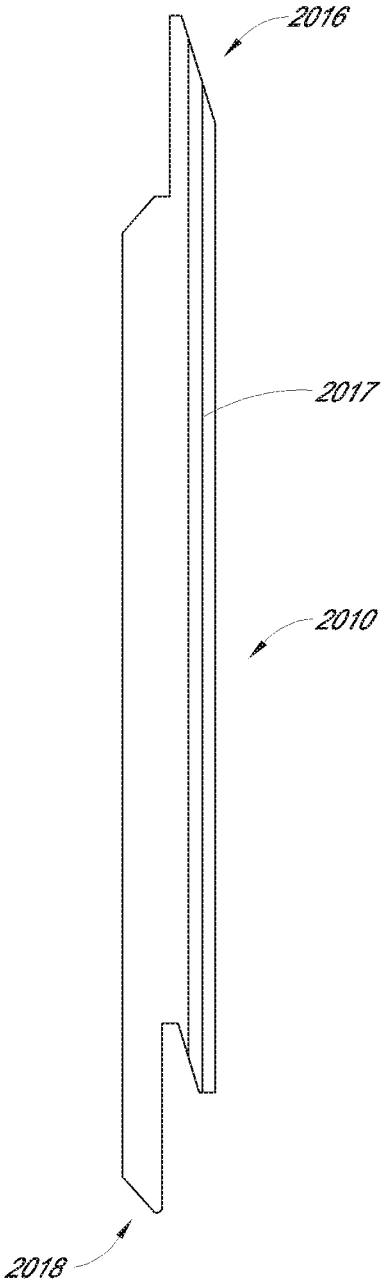
FIG. 4C is a right side view of the cladding element of FIG. 4A.
Figure 4D:
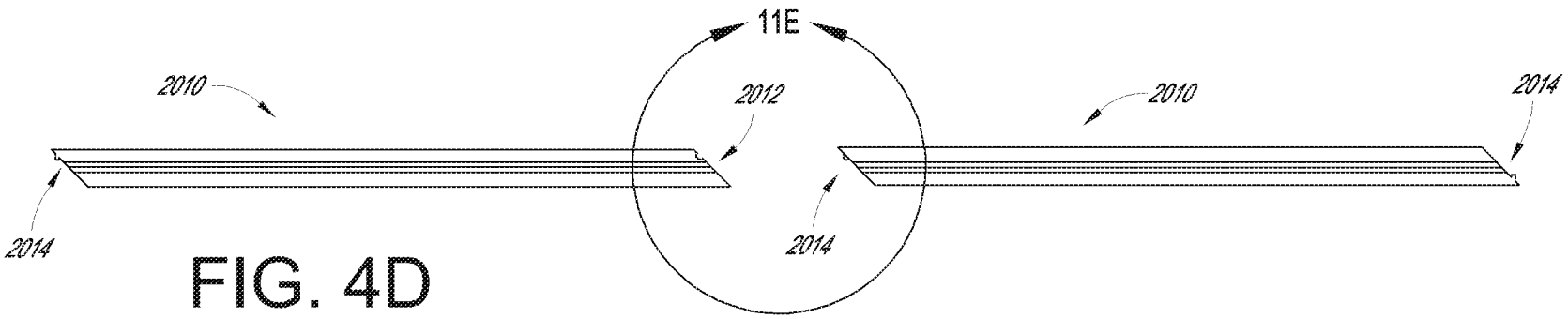
FIG. 4D is a bottom view of two cladding elements of FIG. 4A.
Figure 4E:
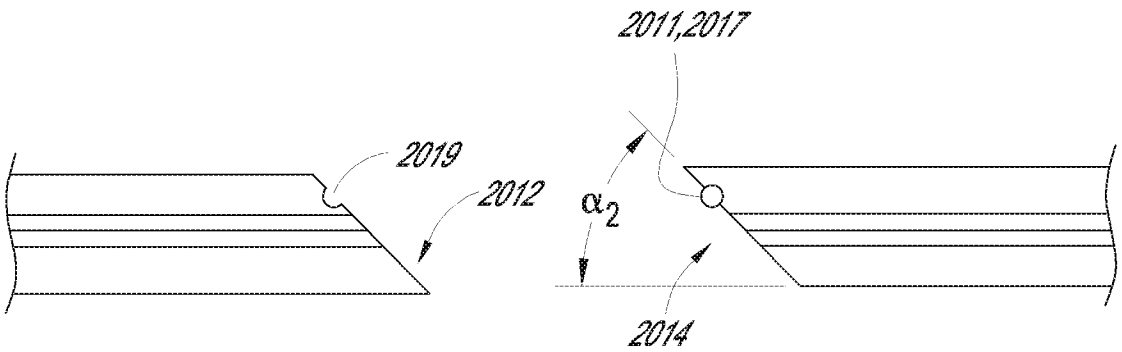
FIG. 4E is a close up bottom view of the joint edges of two cladding elements of FIG. 4A.

The cladding element 2000 can include a first mating edge 2006. As illustrated, the cladding element 2000 can include a second mating edge 2008 distanced from and/or positioned opposite the first mating edge 2006. The first and second mating edges 2006, 2008 can be sized and/or shaped to couple with the first or second mating edges of an adjacent cladding element. In some embodiments, the cladding element 2000 is generally planar and has a generally rectangular shape bound on two opposite sides by the first and second joint edges 2002, 2004 and on the other opposite sides by the first and second mating edges 2006, 2008. As illustrated in FIGS. 3C-3D, the cladding element 2000 can include a first joint feature on the first joint end 2002. For example, the cladding element 2000 can include a sloped joint surface 2003 on the first joint end 2002. The second joint end 2004 can include a second joint surface 2005 sized and/or shaped to matingly correspond to the first joint surface 2003. A slope angle $\alpha 1$ of the joint surfaces 2003, 2005, as measured from a rear surface of the cladding element 2000, can be between 35 and 55 degrees. In some embodiments, the slope angle $\alpha 1$ is between 10 and 40 degrees, between 15 and 55 degrees, and/or between 30 and 85 degrees. Many variations are possible.

FIGS. 4A-4E illustrate an embodiment of a cladding element 2010 wherein some numerical references are the same as or similar to those described previously for cladding element 2000. For example, mating edges 2016, 2018 can the same as or similar to the mating edges 2006, 2008 of the cladding element 2000. The angle $\alpha 2$ of the joint surfaces 2013, 2015 as measured from a rear surface of the cladding element 2010 can be the same as or similar to the angle $\alpha 1$ of the joint surfaces 2003, 2005 of the cladding element 2000. As illustrated in FIGS. 4B-4E, the first and second joint ends 2012, 2014 can include sloped surfaces having sealing channels 2017, 2019 extending along at least a portion of the length of the first and second joint ends 2012, 2014. The sealing channels 2017, 2019 can be sized and/or shaped to accommodate a sealing element, such as an elastomeric rod, caulk, and/or flashing material. For example, the sealing channels 2017, 2019 can be configured to receive a rod 2011 constructed from silicone, rubber, or some other compressible and/or polymeric material. The rod 2011 can reduce moisture transfer from a front side of the cladding elements 2010 to the structure on which the cladding elements 2010 are installed. In some embodiments, the rod 2011 can increase the frictional engagement between adjacent cladding elements 2010 and reduce relative motion between adjacent cladding elements 2010.

FIGS. 5A-5F illustrate an embodiment of a cladding element 2020 wherein some numerical references are the same as or similar to those described previously for cladding element 2000. For example, mating edges 2026, 2028 of the cladding element 2020 can the same as or similar to the mating edges 2006, 2008 of the cladding element 2000.

Figure 5A:
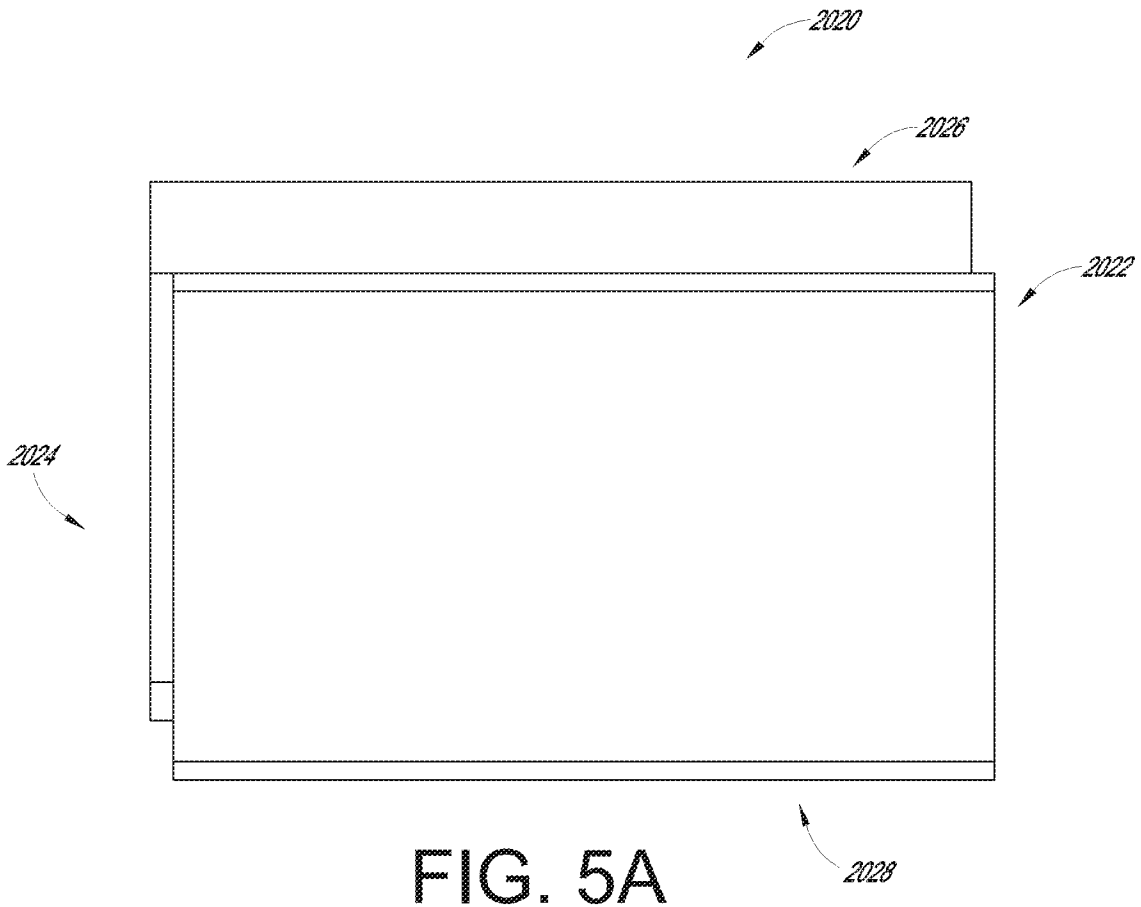
FIG. 5A is a top view of another embodiment of a cladding element.
Figure 5B:
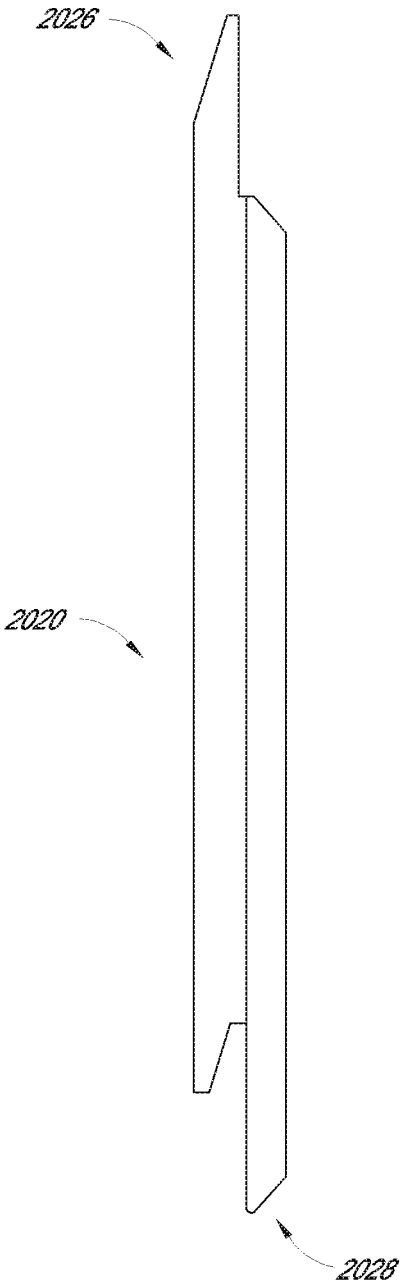
FIG. 5B is a left side view of the cladding element of FIG. 5A.
Figure 5C:
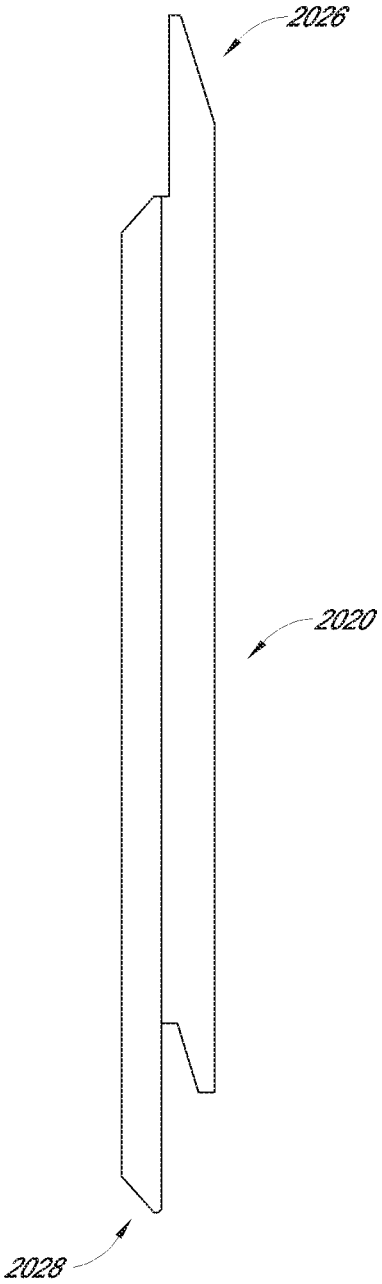
FIG. 5C is a right side view of the cladding element of FIG. 5A.
Figure 5D:
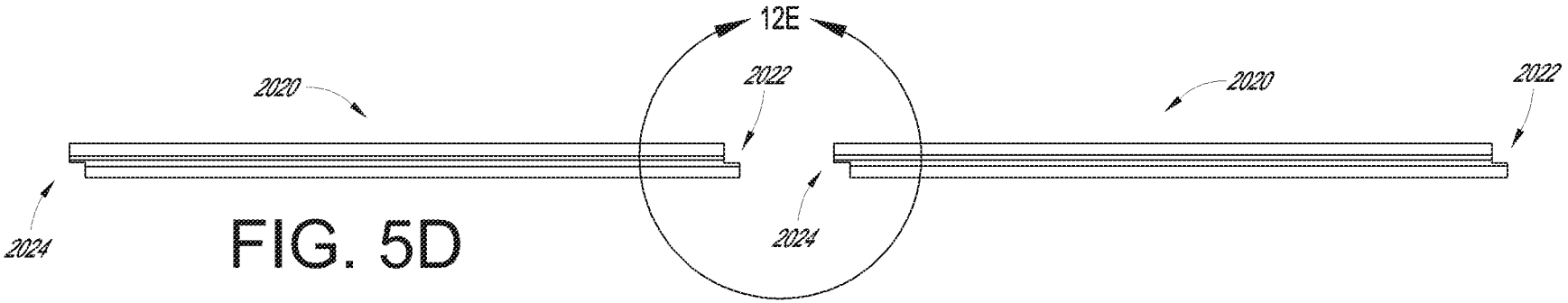
FIG. 5D is a bottom view of two cladding elements of FIG. 5A.
Figure 5E:
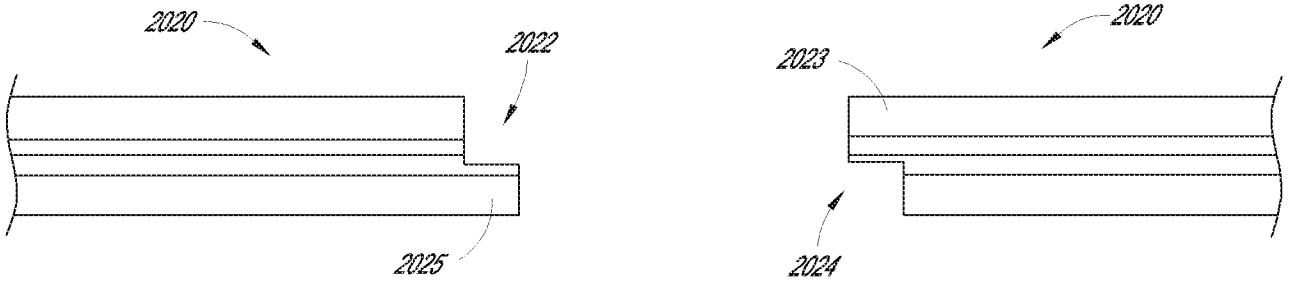
FIG. 5E is a close up bottom view of the joint edges of two cladding elements of FIG. 5A.

As illustrated in FIGS. 5D-5E, the cladding element 2020 can include a first overlap portion 2025 on the first joint end 2024. In some cases, the cladding element 2020 includes a second overlap portion 2023 on the second joint end 2024. The first overlap portion 2025 can be configured to overlap (e.g., in a direction substantially parallel to the mating edges 2026, 2028 of the cladding elements 2020) a second overlap portion 2023 of a second cladding element 2020 when the cladding elements 2020 are installed on a wall. The overlap of the first and second overlap portions 2025, 2023 can create a labyrinthine seal between the adjacent cladding elements 2020 to reduce moisture passage through the assembled cladding elements 2020. In some cases, the overlap portions 2023, 2025 remain overlapped as the cladding elements 2020 shrink or expand (e.g., in response to chemical changes, evaporation, temperature changes, etc.).

Figure 5F:
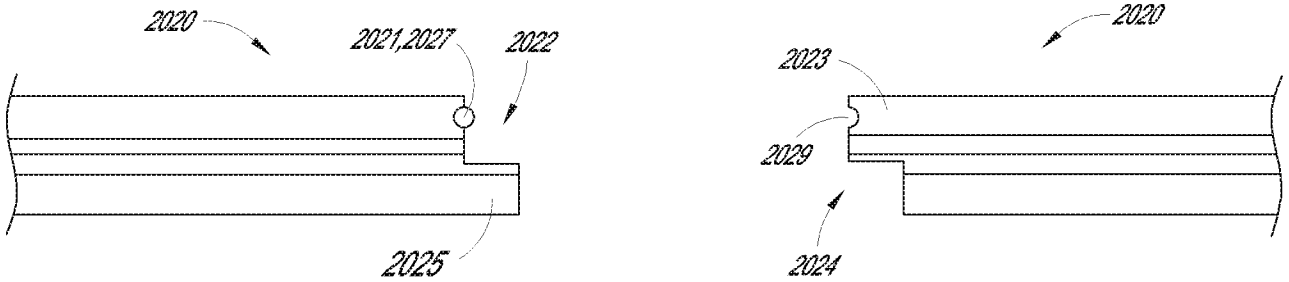
FIG. 5F is a close up bottom view of the joint edges of an embodiment of a cladding element having a sealing member.

In some embodiments, as illustrated in FIG. 5F, one or more of the overlap portions 2023, 2025 includes a sealing channel 2029. The channel 2029 can be configured to receive a sealing element. For example, the channel 2029 can be configured to receive a sealing rod 2021. The sealing rod 2021 can be the same as or similar to the sealing rod 2011 described above. As illustrated in FIG. 5F, the cladding element 2020 can include a second channel 2027 positioned on a surface corresponding to the overlap portion 2023, 2025 in which the sealing channel 2029 is positioned. In some cases, the second channel 2027 can be sized and/or shaped to accommodate at least a portion of the sealing rod 2021.

Figure 6A:
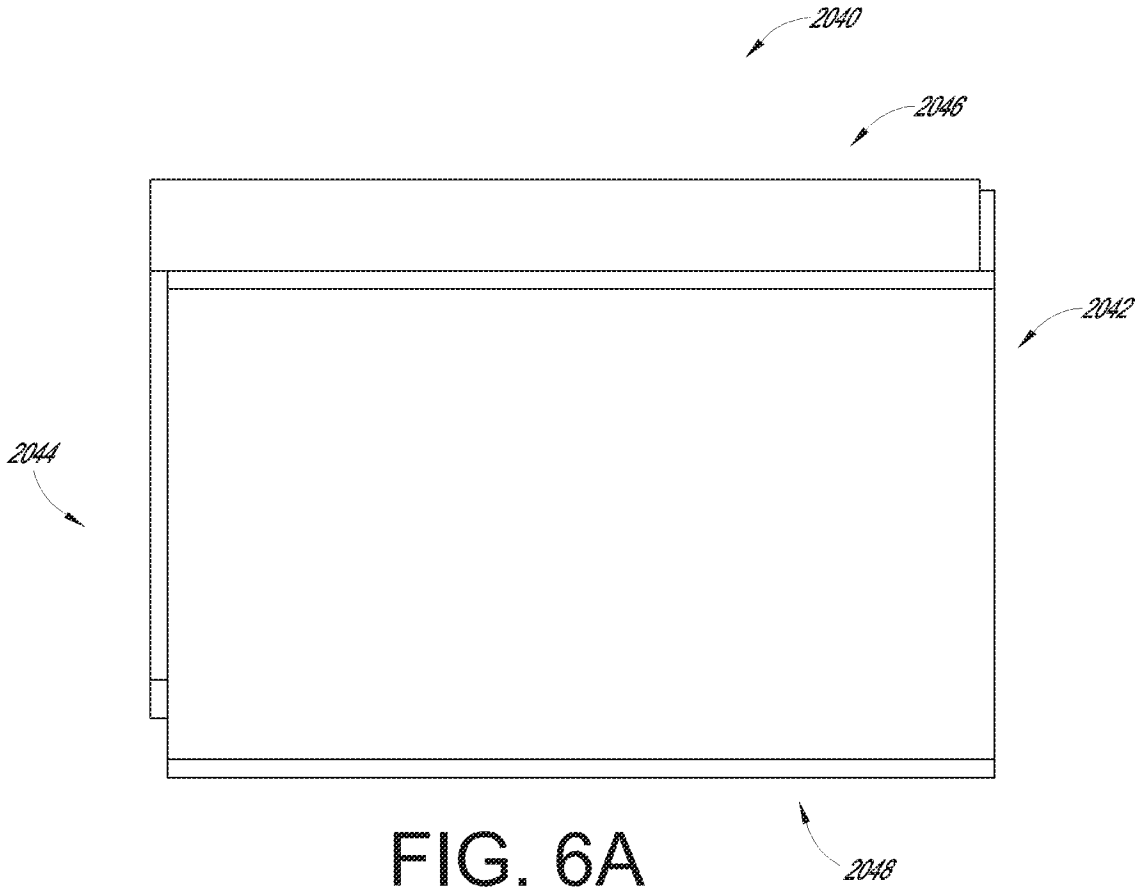
FIG. 6A is a top view of another embodiment of a cladding element.
Figure 6B:
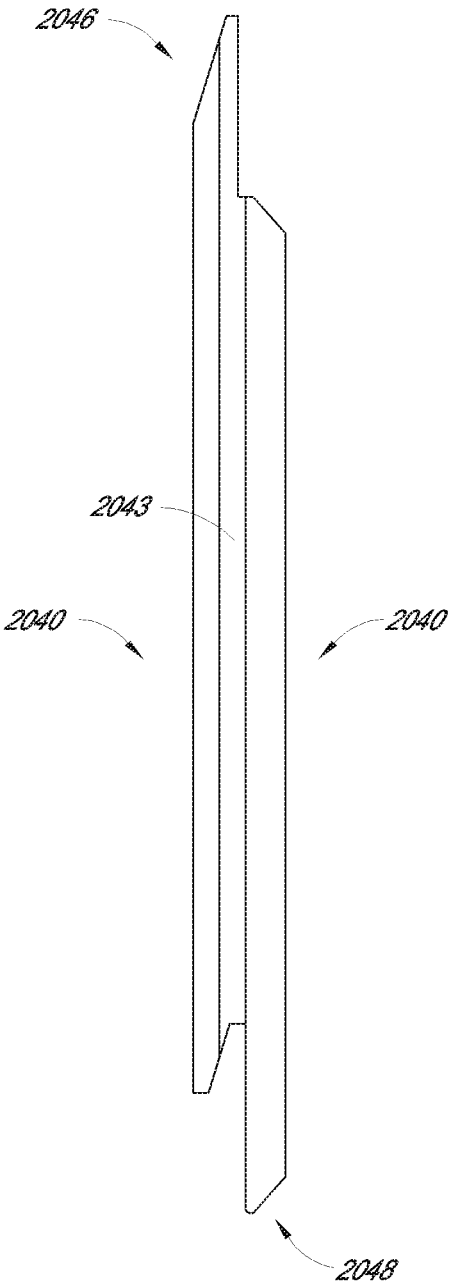
FIG. 6B is a left side view of the cladding element of FIG. 6A.
Figure 6C:
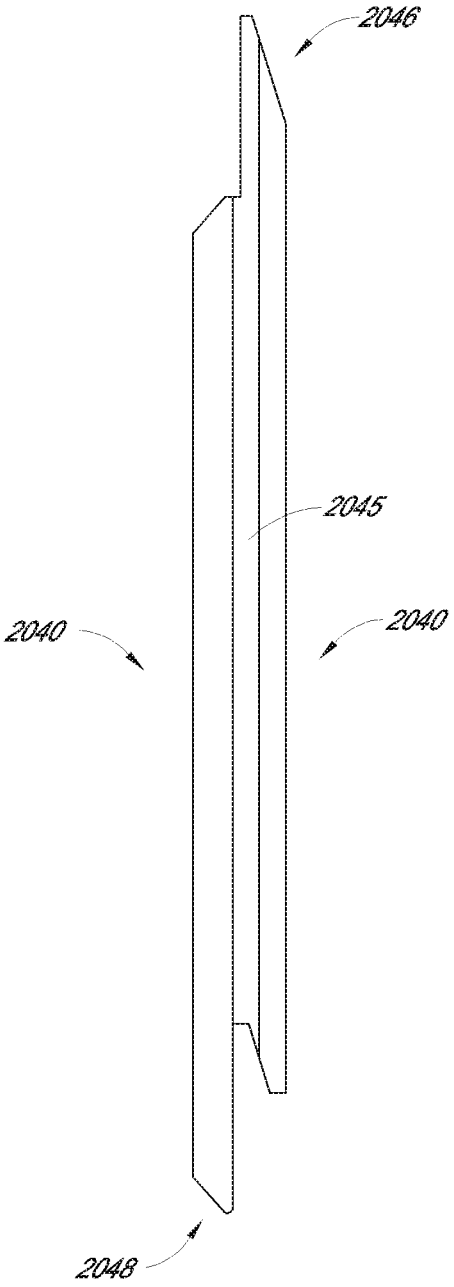
FIG. 6C is a right side view of the cladding element of FIG. 6A.
Figure 6D:
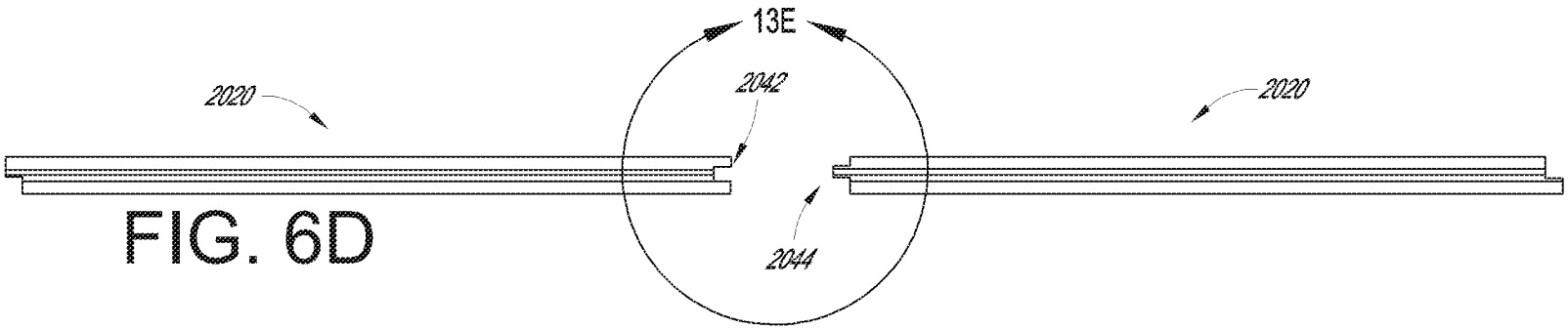
FIG. 6D is a bottom view of two cladding elements of FIG. 6A.
Figure 6E:
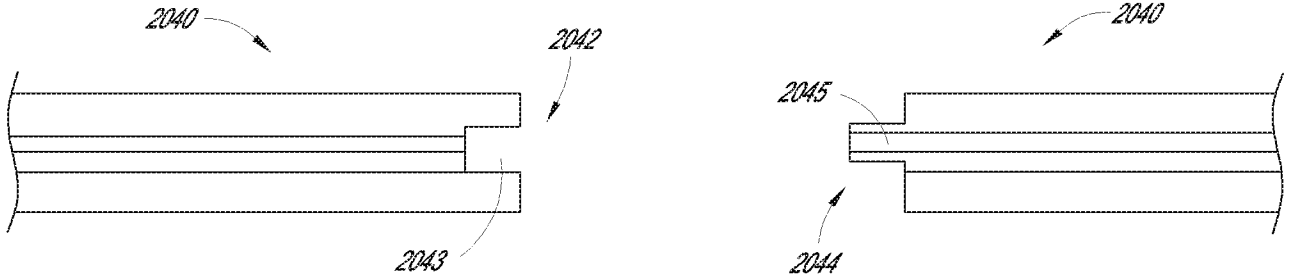
FIG. 6E is a close up bottom view of the joint edges of two cladding elements of FIG. 6A.

FIGS. 6A-6E illustrate an embodiment of a cladding element 2040 wherein some numerical references are the same as or similar to those described previously for cladding element 2000. For example, mating edges 2046, 2048 of the cladding element 2040 can the same as or similar to the mating edges 2006, 2008 of the cladding element 2000. As illustrated in FIGS. 6D-6E, the cladding element 2040 can include a joint channel 2042 on the first joint edge 2043 of the cladding element 2040. The second joint edge 2044 of the cladding element 2040 can include a joint flange 2045 configured to mate with the joint channel 2043 of an adjacent cladding element 2040. In some embodiments, one or more surfaces of the first joint edge 2043 and the second joint edge 2044 can include a channel configured to house at least a portion of a sealing element (e.g., a sealing element as described above with respect to cladding elements 2010, 2020).

FIGS. 7A-7E illustrate an embodiment of a cladding element 2060 wherein some numerical references are the same as or similar to those described previously for cladding element 2000. For example, mating edges 2066, 2068 of the cladding element 2060 can the same as or similar to the mating edges 2006, 2008 of the cladding element 2000. The angle $\alpha 3$ of the joint surfaces 2063, 2065 as measured from a rear surface of the cladding element 2060 can be the same as or similar to the angle $\alpha 1$ of the joint surfaces 2003, 2005 of the cladding element 2000.

Figure 7A:
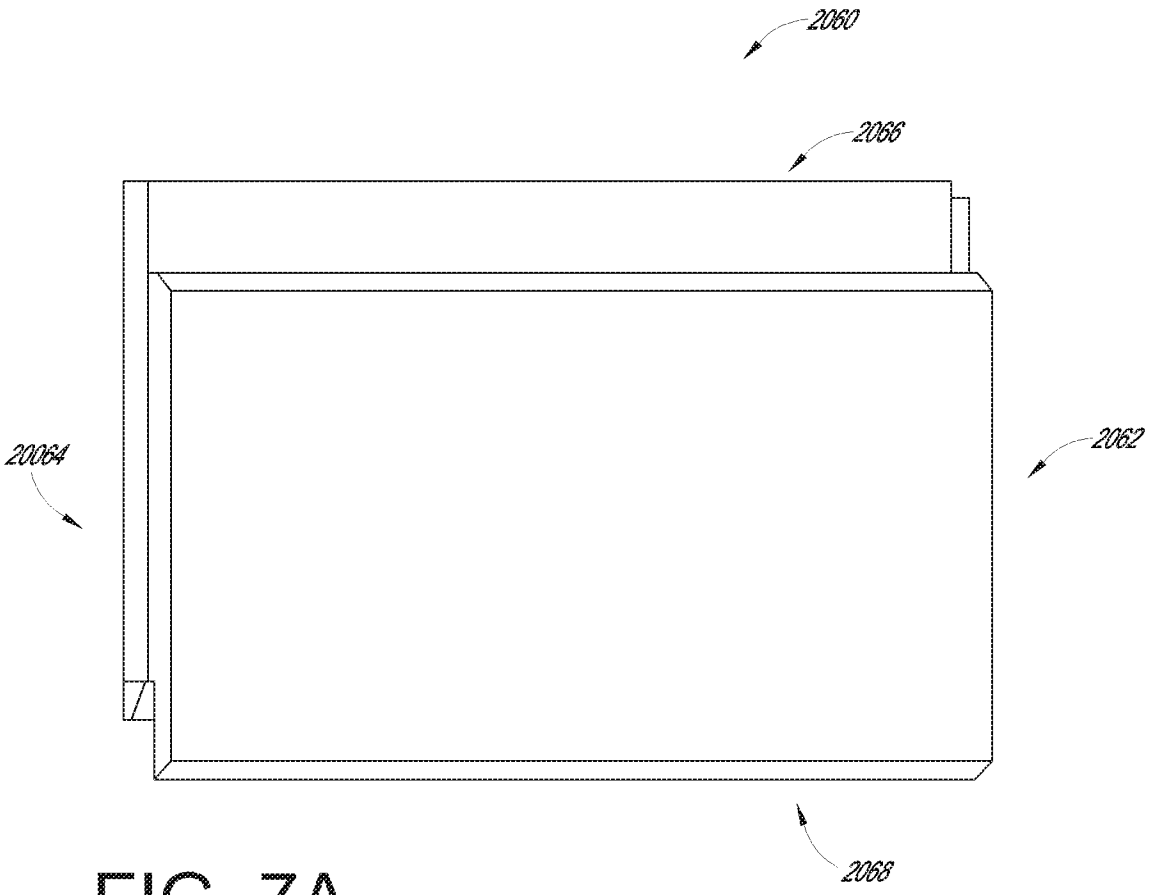
FIG. 7A is a top view of another embodiment of a cladding element.
Figure 7B:
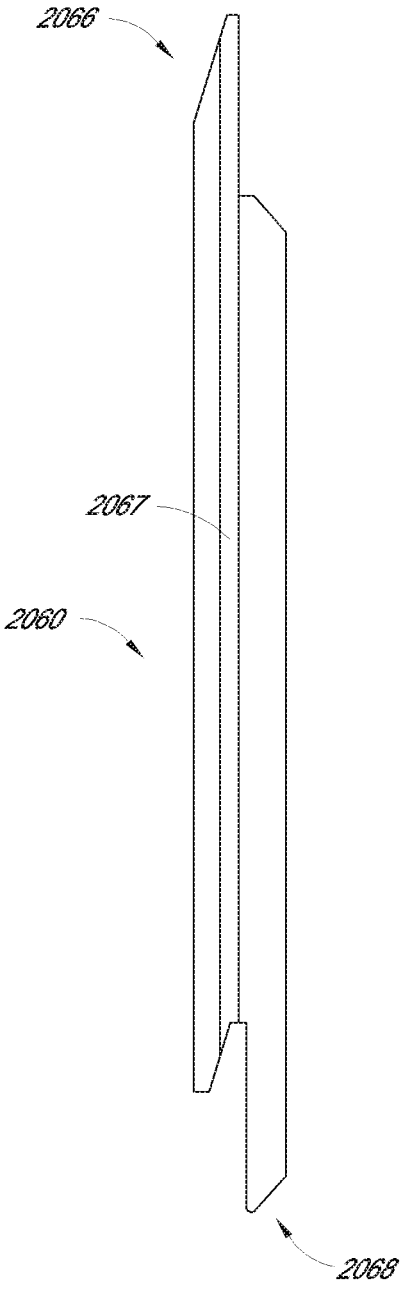
FIG. 7B is a left side view of the cladding element of FIG. 7A.
Figure 7C:
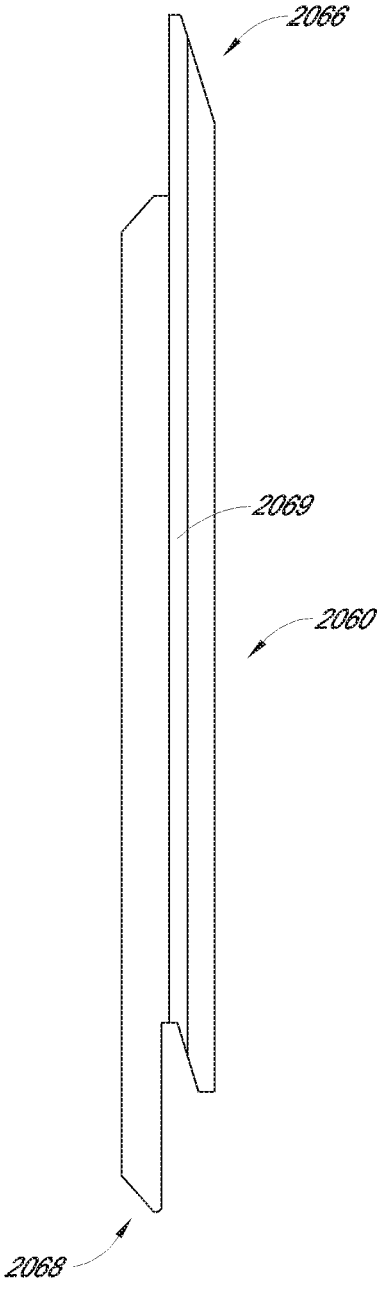
FIG. 7C is a right side view of the cladding element of FIG. 7A.
Figure 7D:
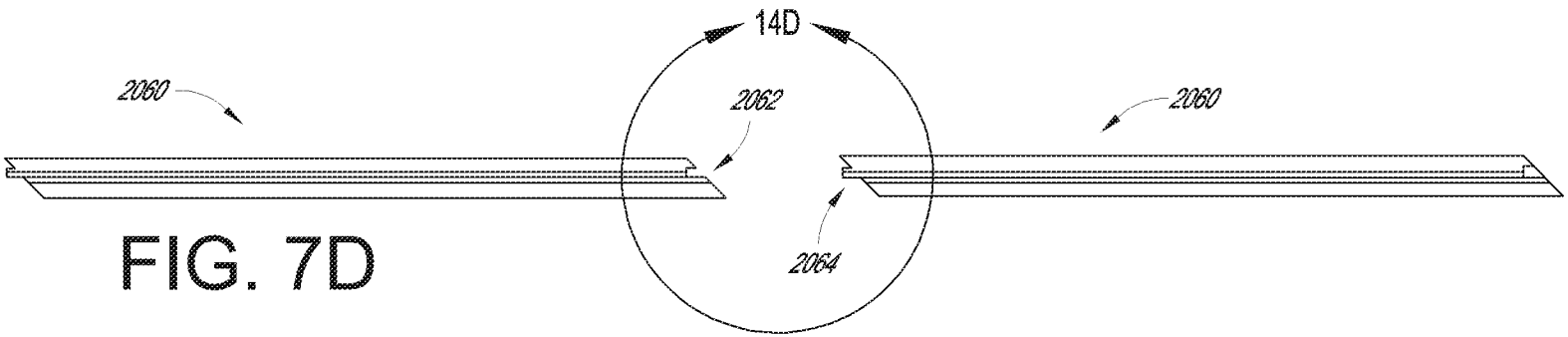
FIG. 7D is a bottom view of two cladding elements of FIG. 7A.
Figure 7E:
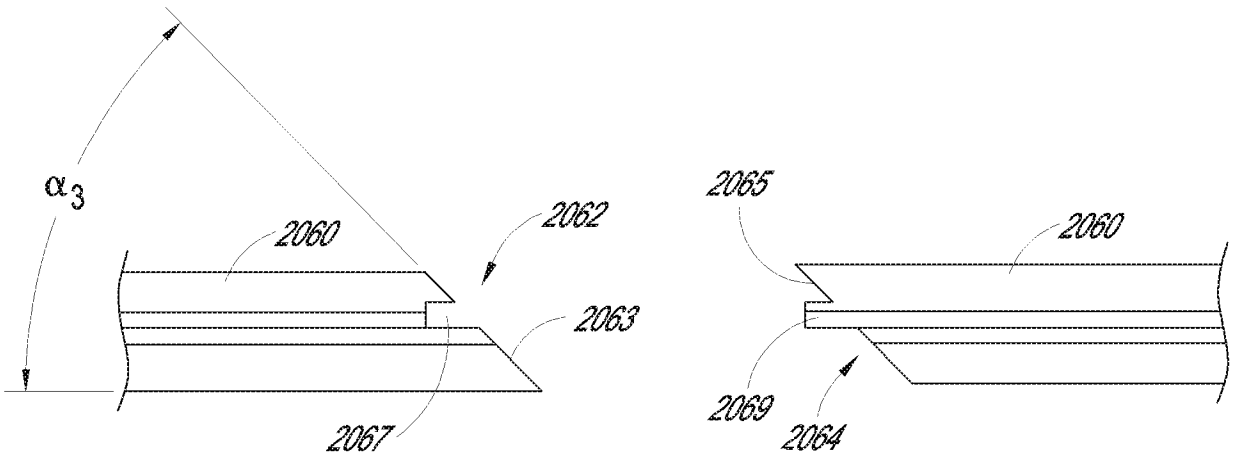
FIG. 7E is a close up bottom view of the joint edges of two cladding elements of FIG. 7A.

As illustrated in FIGS. 7C-7E, the cladding element 2060 can include a joint channel 2067 on the first joint surface 2063 of the cladding element 2060. The second joint surface 2065 of the cladding element 2060 can include a joint flange 2069 configured to mate with the joint channel 2067 of an adjacent cladding element 2060. In some embodiments, one or more surfaces of the first joint edge 2062 and the second joint edge 2064 can include a channel configured to house at least a portion of a sealing element (e.g., a sealing element as described above with respect to cladding elements 2010, 2020).

The use of joint edges (e.g., non-flat and perpendicular edges) to mate the ends of the cladding elements in a cladding system can increase the cladding system's resistance to moisture passage through the assembled cladding elements. For example, the joint edges 2043, 2045 of the cladding elements 2040 of FIGS. 6A-6E can prevent or substantially prevent most or all moisture passage through the joints 2043, 2045, with or without the use of caulk or other sealing materials. Avoiding the use of caulk or other sealing materials, while maintaining minimal or no moisture passage through the cladding system, can greatly reduce material and/or labor costs associated with cladding systems.

In some embodiments, cladding elements are advantageously arranged in a cladding system wherein a plurality of elements (e.g., any of the elements described above) are arranged such that the profiled edges of two elements are mated with each other. Additional elements can be arranged in connection with the two elements such that the joint edges of the adjacent elements in the cladding system are mated to each other. The cladding elements can be arranged in a number of different patterns, including, but not limited to, patterns in which the mating interfaces between the joint edges of pairs of elements align with each other in a direction parallel to the joint edges. In some cases, mating interfaces between joint edges of cladding elements in a respective row are offset in a direction perpendicular to the mating interfaces between the joint edges of cladding elements in adjacent rows (e.g., or columns in scenarios where the cladding elements are arranged vertically). For example, the cladding elements in a cladding system can be arranged in a stretcher bond pattern. Overlap between the respective mating interfaces (e.g., joint mating interfaces and profiled edge mating interfaces) of the adjacent cladding elements in the cladding systems can improve the overall characteristics of the system. These improved characteristics include, but are not limited to, wind resistance, water resistance, debris resistance, and/or impact resistance. For example, the interfaces between the profiled edges and the joint ends of the respective cladding elements can facilitate improved performance of the cladding system in both the vertical and horizontal directions (e.g., load and impact energy transfer between elements in both directions). Further, as discussed above, the mating interfaces between the cladding elements can increase the efficiency of constructing the cladding systems, as the interfaces can provide confirmation of alignment between the adjacent cladding elements.

Figure 8:
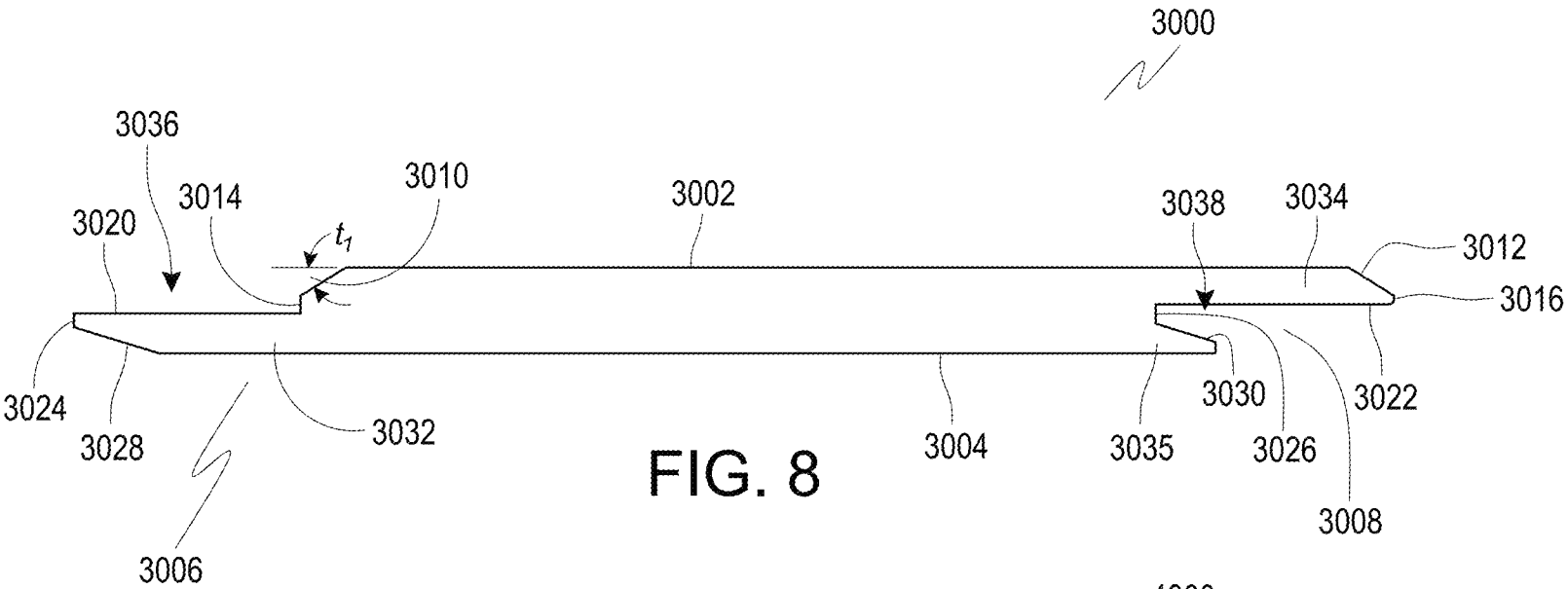
FIG. 8 is a cross-sectional side view of one embodiment of a cladding element.

Referring now to FIG. 8, there is shown a first embodiment of a cladding element 3000, comprising a first surface 3002 and a second surface 3004 spaced apart from the first surface 3002.

Figure 9:
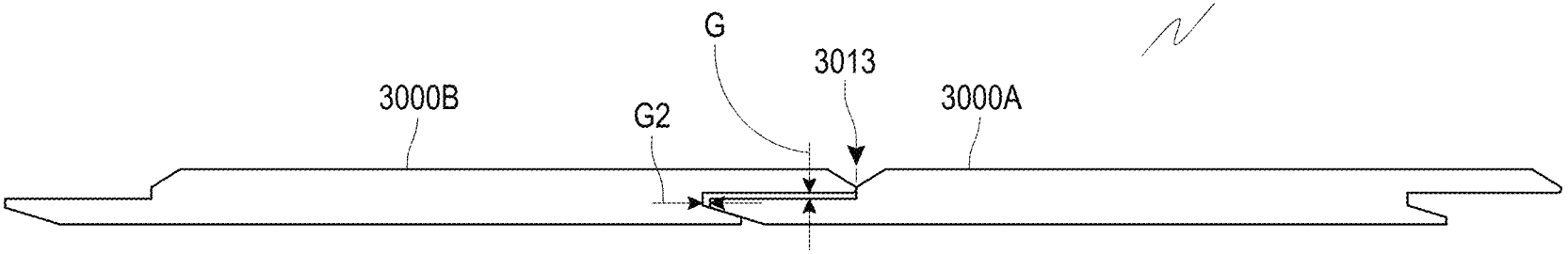
FIG. 9 is a cross-sectional side view of a cladding system having two mated cladding elements of FIG. 8.
Figure 10:
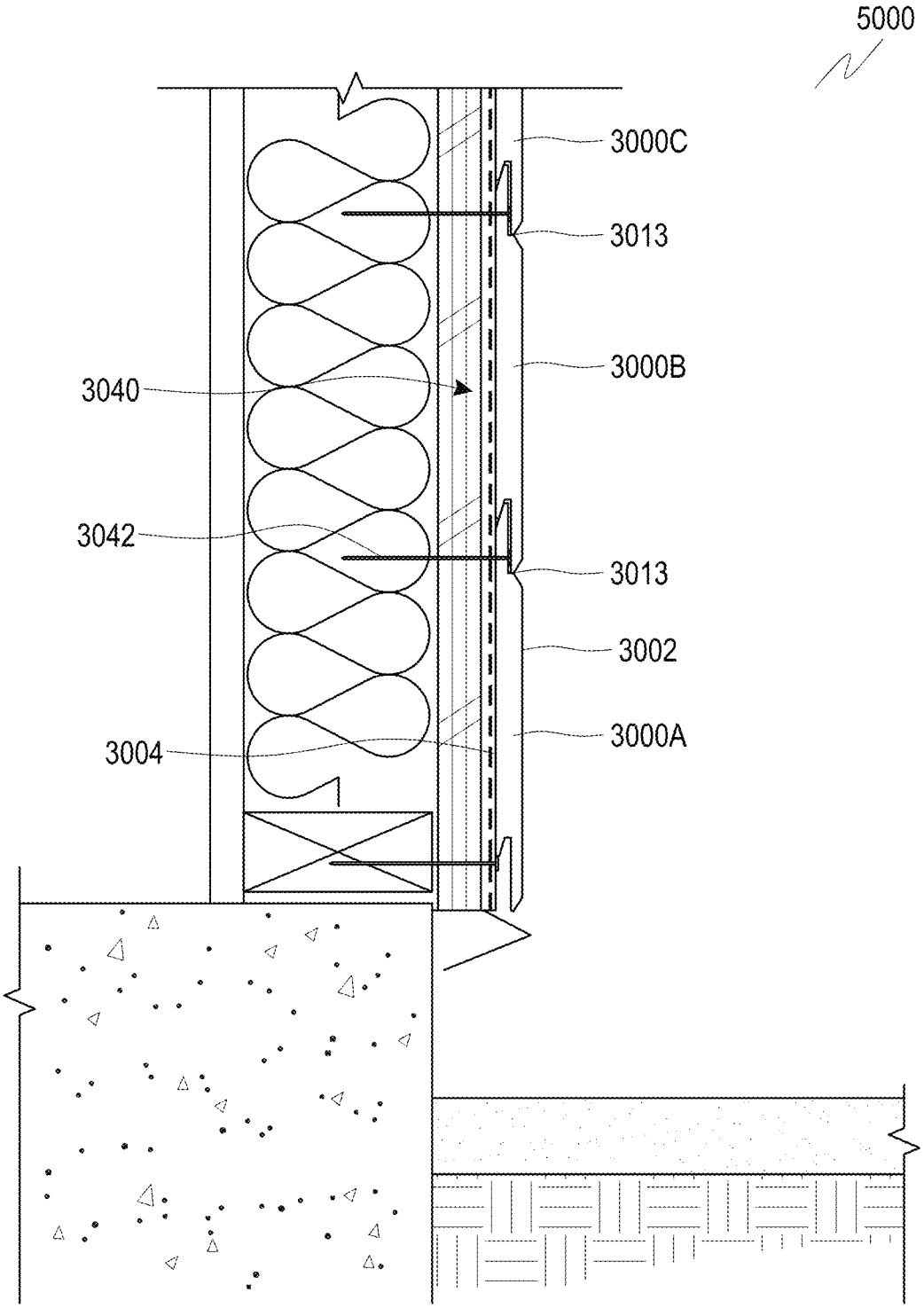
FIG. 10 is a cross-sectional side view of a plurality of cladding elements installed in series on a substrate.

FIGS. 9 and 10 illustrate two embodiments of a cladding system 4000, 5000 respectively comprising two or more cladding elements 3000 in an assembled configuration. For ease of reference cladding elements 3000 in cladding systems 4000 and 5000, have been labelled sequentially as 3000A, 3000B, 3000C and so forth. Cladding system 5000, demonstrates that the first surface 3002 of cladding element 3000 forms an external surface remote from a substructure 3040 when in the assembled configuration and the second surface 3004 of cladding element 3000 forms an internal surface adjacent substructure 3040 when cladding element 3000 is in an assembled configuration.

FIGS. 8-10 will be described in greater detail in the following. The first surface 3002 and a second surface 3004 of cladding element 3000 are spaced apart from each other by a defined thickness T and bound on each side by opposing side sections. Opposing contoured first and second side sections 3006, 3008 are shown in FIGS. 8-10. Two further opposing side sections, not shown in the drawings are located substantially perpendicularly to contoured side sections 3006, 3008 such that each of the side sections together form a continuous edge surface around the perimeter of the cladding element 3000 between the first surface 3002 and second surface 3004. In one embodiment, the contoured side sections 3006, 3008 and further opposing side sections located substantially perpendicularly to contoured side sections 3006, 3008 are integrally formed with the first and second surface 3002, 3004 respectively of cladding element 3000. In one embodiment, cladding element 3000 has a thickness T of between approximately 11 mm±0.5 mm and approximately 17 mm±0.5 mm. In a further embodiment the cladding element 3000 has a thickness T of between approximately 11 mm±0.5 mm and approximately 13 mm±0.5 mm. In a further embodiment the cladding element 3000 has a thickness T of approximately 12 mm±0.5 mm. Cladding element 3000 may have a thickness T of less than 1 mm or more than approximately 12 mm, such as approximately 13 mm, approximately 15 mm, approximately 16 mm, approximately 17 mm, or more.

In the embodiment shown in FIG. 8, each of the contoured side sections 3006, 3008 facilitate mating of adjacent cladding elements 3000 when assembled in a cladding system 4000, 5000 as shown in FIGS. 9 and 10. Each of contoured side sections 3006, 3008 each comprise first and second flange portions 3032 and 3034 respectively and first and second recessed portions 3036 and 3038 respectively. First flange portion 3032 of first side section 3006 is configured to facilitate location of one or more fasteners (3042 in FIG. 10) to secure a cladding element 3000 to a substructure (3040 in FIG. 10) or wall whilst also facilitating location of second flange portion 3034 such that second contoured side section 3008 mates with first contoured side section 3006.

Turning now to describe the contours of each of first and second contoured side sections 3006, 3008 of FIG. 8 in detail.

First and second contoured side sections 3006, 3008 each comprise a beveled sloping surface 3010, 3012 extending in opposing directions from first surface 3002. A first abutment surface 3014 extends from beveled sloping surface 3010 whereby first abutment surface 3014 extends substantially perpendicular to both the first surface 3002 and second surface 3004.

A second abutment surface 3016 extends from beveled sloping surface 3012 whereby second abutment surface 3016 extends substantially perpendicular to both the first surface 3002 and second surface 3004.

First and second substantially planar surfaces 3020 and 3022 extend substantially orthogonally from first and second abutment surfaces 3014 and 3016 respectively whereby the first and second substantially planar surfaces 3020 and 3022 are substantially parallel with first and second surface 3002 and 3004 respectively.

A portion of first surface 3002, beveled sloping surface 3012, second abutment surface 3016 extending from beveled sloping surface 3012 and second substantially planar surface 3022 together form second flange portion 3034 whereby second substantially planar surface 3022 forms the base surface remote from the first surface 3002 of flange portion 3034.

First substantially planar surface 3020 terminates at junction 3024 from which first angled surface 3028 extends to meet second surface 3004. First substantially planar surface 3020, junction 3024, first angled surface 3028 and a portion of second surface 3004 together form first flange portion 3032. First substantially planar surface 3020 forms the nailing surface of flange portion 3032. Flange portion 3032 is recessed with respect to first surface 3002 defining a recessed portion 3036 between the first substantially planar surface 3020 and first surface 3002.

Second contoured side section 3008 further comprises an offset section 3026 which extends substantially orthogonally from second substantially planar surface 3022 thereby forming an open area or second recessed portion 3038 between the second substantially planar surface 3022 and the second surface 3004. A second angled surface 3030 extends from the offset section 3026 to meet the second surface 3004. The area between the second surface 3004 and second angled surface 3030 is referred to as the retention portion 3035.

The first and second contoured sections 3006, 3008 are configured such that when two cladding elements 3000 are seated together the second flange portion 3034 of second contoured section 3008 seats over the first flange portion 3032 of first contoured section 3006 whereby first flange portion 3032 is positioned within the second recessed portion 3038 and the second flange portion 3034 is positioned within the first recessed portion 3036. In such an arrangement, retention portion 3035 of second contoured side section 3008, specifically second angled surface 3030 of retention portion 3035 abuts first angled surface 3028 of first contoured side section 3006. In addition, first abutment surface 3014 of first contoured side section 3006 abuts second abutment surface 3016 of second contoured side section 3008 such that first and second beveled sloping surfaces 3010, 3012 form a v-groove profile 3013 at the interface between the two cladding elements 3000 as shown in FIG. 9.

Cladding element 3000 may be installed in the form of a cladding system on a building (e.g. an interior or exterior wall), as illustrated in FIG. 10, wherein cladding elements 3000A, 3000B and 3000C are installed in series on substructure 3040 thereby forming an exterior façade surface of a building wall.

In practice, a first cladding element 3000A is installed on substructure 3040 by inserting one or more fasteners 3042 through the first substantially planar surface 3020 of first contoured side section 3006. A second cladding element 3000B is then installed over the first cladding element 3000A whereby the second contoured side section 3008 interlocks with the first contoured side section 3006. One advantage of the cladding elements 3000 when assembling a cladding system such as that shown in FIG. 10, is that an installer may use a level or other tool to confirm the alignment of the first-installed cladding element 3000A but subsequent courses, i.e., the second cladding element 3000B can be installed without the use of an alignment tool, as the mating of first and second contoured side section 3006, 3008 of adjacent cladding elements 3000A and 3000B or 3000B and 3000C align the subsequent cladding elements with the first-installed cladding element 3000.

As shown in FIG. 9, a gap G is provided between first substantially planar surface 3020 of first contoured side section 3006 and second substantially planar surface 3022 of second contoured side section 3008 when the first and second cladding elements 3000A and 3000B are seated together. The gap G can be between 0.254 mm (0.01 inches) and 2.54 mm (0.1 inches) when measured perpendicular to the first substantially planar surface 3020 and second substantially planar surface 3022. In some embodiments, the gap G is approximately 1.524 mm (0.06 inches) when measured perpendicular to the first substantially planar surface 3020 and second substantially planar surface 3022. A second gap G2 is also formed between the offset section 3026 of second contoured side section 3008 and junction 3014 first contoured side section 3006. The second gap G2 can be connected to and/or continuous with the gap G.

The fasteners 3042 are hidden from view within the gap G by the second flange portion 3034 of the second cladding element 3000B when second cladding element 3000B interlocks with the first cladding element 3000A. Utilizing such a fastening process (e.g., "blind" nailing) can improve the aesthetics of an assembled cladding system comprising cladding elements 3000. In some cases, blind nailing can increase the durability of the assembled cladding elements 3000 by, for example, reducing exposure of the fasteners and their respective holes to moisture and other outside elements. In some applications, blind nailing can reduce the costs of installing the cladding elements 3000 on a wall by reducing the number of fasteners required to install the cladding elements 3000 and thereby reducing the amount of time required to install the cladding elements 3000. In addition, the geometry of the cladding element 3000 enables an end user to construct a cladding system 5000 as shown in FIG. 10, utilizing the above described blind nailing process and achieve a satisfactory wind load requirement when the cladding element 3000 has a thickness T of 12 mm±1 mm without the use of a clip mechanism.

The gaps G and/or G2 can be sized and/or shaped to accommodate adhesives, sealants, insulators, and/or other materials.

Positioning materials in the gap G between first substantially planar surface 3020 of first contoured side section 3006 and second substantially planar surface 3022 of second contoured side section 3008 can increase the weather resistance of the assembled cladding elements 3000 by reducing the likelihood that moisture (e.g., rain, condensation, etc.) will enter pass between adjacent cladding elements 3000. In some embodiments, sealant or other materials can also be inserted into the second gap G2 in addition to or instead of sealant or other materials into gap G.

The configuration of the first and second contoured side sections 3006, 3008 provide an interlocking mechanism for the cladding elements 3000 of the cladding system 4000, 5000 that increases wind load performance particularly in the instance when thickness T is between approximately 11 mm±0.5 mm and approximately 13 mm±0.5 mm and more particularly at approximately 12 mm±0.5 mm.

A plurality of cladding elements 3000 wherein thickness T was approximately 12 mm±0.5 mm were arranged to form a cladding system which was tested for wind loading capabilities using a standard test method for structural performance of exterior cladding. The frame spacing used was 23"-⅝" using a 4D ring shank fastener. The average wind load achieved for cladding elements 3000 was 83.75 psf.

Figure 11:
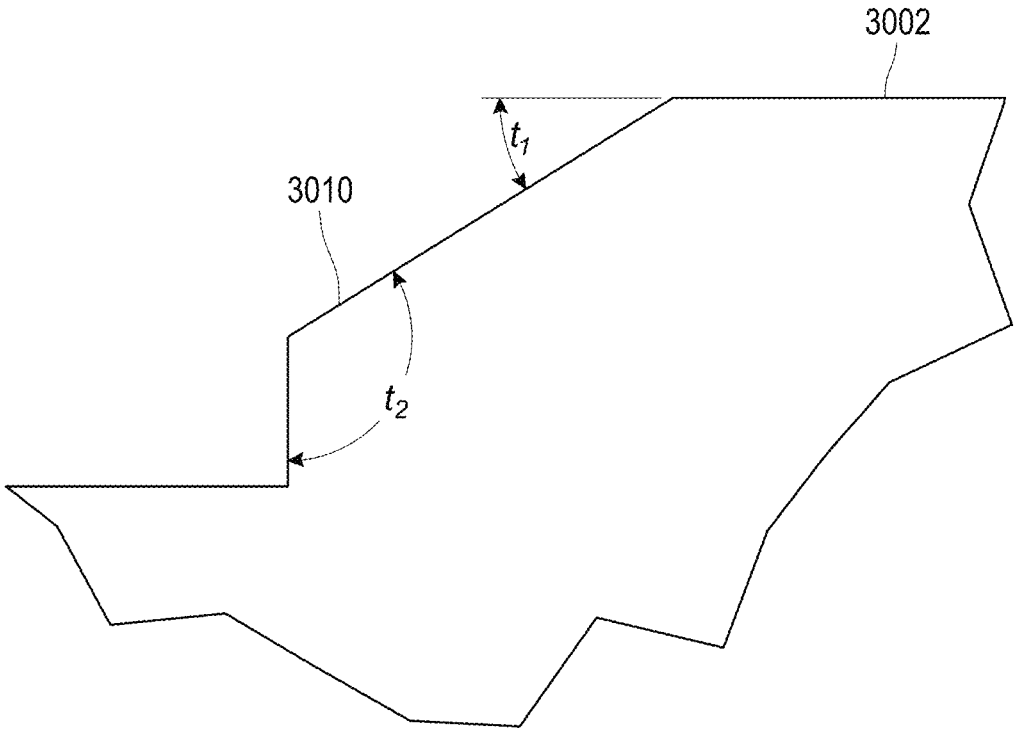
FIG. 11 is an enlarged cross-sectional side view of the bevel area of one embodiment of a cladding element.

Referring now specifically to FIGS. 8 and 11, each of beveled sloping surfaces 3010, 3012 extend at an angle from the first surface 3002 hereinafter referred to as the tangential angle $t_1$, whereby Tan $t_1$ is defined as being the length of the opposite side divided by the length of the adjacent side. In each of the contoured side section 3006, the opposite side is defined as being the distance between first surface 3002 and a corresponding co-planar axis parallel to first surface 3002 extending from the end of the beveled sloping surfaces 3010 remote the first surface 3002. The adjacent side is defined as being the distance between the two parallel co-planar axes extending from each end of the beveled sloping surfaces 3010 perpendicular to the first surface 3002. In one embodiment the tangential angle $t_1$ is between approximately 32° and approximately 47.5°±2°.

In a similar way, the angle at the junction between the end of the beveled sloping surface 3010 opposite the first surface 3002 and first abutment surface 3014, angle $t_2$ is between approximately 122° and approximately 131°±1°. In a further embodiment, angle $t_2$ is approximately 122°±1°.

Figure 12:
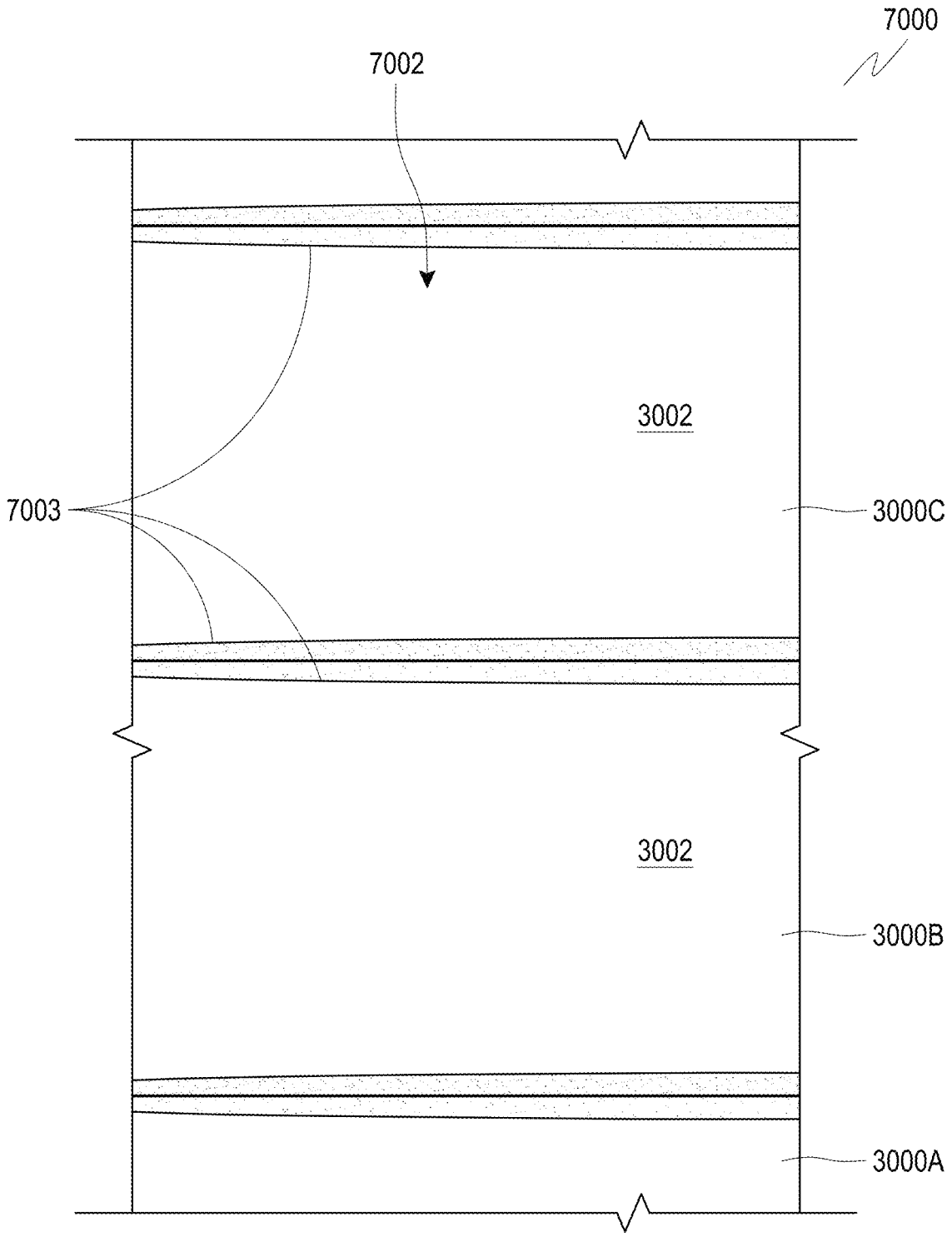
FIG. 12 is a front elevation view of a series of cladding elements of FIG. 11.

Turning now to FIG. 12, there is shown a section of a cladding system 7000 comprising a plurality of cladding elements 3000, the first surface 3002 of each cladding element 3000 forms the exterior front surface 7002 of the cladding system 7000. In this particular embodiment, cladding element 3000 has a thickness T of approximately 12 mm±0.5 mm, accordingly the tangential angle $t_1$ of the first and second beveled sloping surface 3012, 3014 is approximately 32°±1°. Surprisingly, a perceptible visual variation was seen at the interface between two adjacent cladding elements 3000 in the instance when the tangential angle $t_1$ of the first and second beveled sloping surface 3012, 3014 was approximately 32°±1° was viewed by an end user. The perceptible variation was seen as wavy line 7003 by end users. As it is desirable in one embodiment to provide a cladding element with a thickness T of approximately 12 mm±0.5 mm wherein, each cladding element is contoured to achieve interlocking which delivers acceptable wind load requirements without the use of a clip mechanism it was preferable to provide a solution that did not have a perceptible visual variation.

Figure 13:
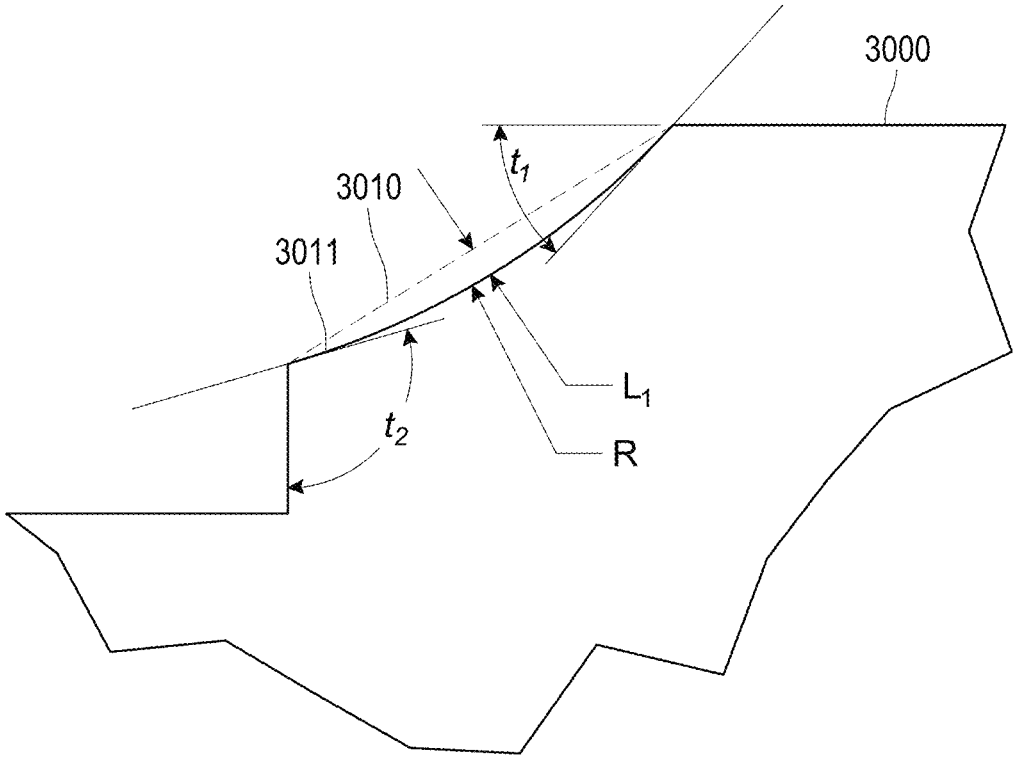
FIG. 13 is an enlarged cross-sectional side view of a second bevel area of one embodiment of a cladding element.

Turning now to FIG. 13, there is shown a beveled sloping surface 3010 (shown in dotted line) of cladding element 3000 wherein a slight curvature has been introduced to the beveled sloping surface 3010 thereby forming a concave beveled surface 3011 having a radius of curvature R. In the embodiment shown, the distance between the beveled sloping surface 3010 and the concave beveled surface 3011 is defined as $L_1$. The effect of reducing the position of the beveled sloping surface 3010 by a distance $L_1$ through the introduction of a slight curvature to the beveled sloping surface 3010 is that the tangential angle $t_1$ effectively increases and the perceptible variation seen by end users is removed.

FIGS. 14A-14G show a series of beveled sloping surface 3010 (shown in dotted line) of cladding element 3000 wherein the radius of curvature introduced has been varied creating an array of concave beveled surfaces 3011. The tangential angles $t_1$ shown in FIGS. 14A-14G are merely illustrative examples, and it will be understood that any intermediate value of angle $t_1$ between those explicitly illustrated in FIGS. 14A-14G may equally be incorporated. FIG. 14A illustrates an example tangential angle of $t_1$=35°. FIG. 14B illustrates an example tangential angle of $t_1$=40°. FIG. 14C illustrates an example tangential angle of $t_1$=41°. FIG. 14D illustrates an example tangential angle of $t_1$=45°. FIG. 14E illustrates an example tangential angle of $t_1$=47.5°.

FIG. 14F illustrates an example tangential angle of $t_1$=50°. FIG. 14G illustrates an example tangential angle of $t_1$=55°. FIGS. 15A-15G show the series of concave beveled surfaces 3011 as applied to each of the first and second beveled sloping surface 3010, 3012 at the interface between two adjacent cladding elements 3000. It can be seen that the interface angle θ increases as the tangential angle $t_1$ increases.

Table 1, below, summarizes the selection of radius of curvature r, corresponding distances $L_1$ and tangential angle $t_1$ by which the beveled sloping surface 3010 can be adjusted through the introduction of a concave beveled surface 3011 as shown in FIGS. 14A-14G and the interface angle θ as shown in FIGS. 15A-15G.

TABLE 1

Relationship between radius of curvature and distance $L_1$, tangential angle $t_1$, and interface angle θ.

| Radius Of Curvature r/mm | Distances $L_1$/mm | Tangential Angle $t_1$/° | Interface Angle θ/° |
|---|---|---|---|
| 67.61 | 0.10 | 35 | 123 |
| 26.30 | 0.27 | 40 | 133 |
| 22.60 | 0.31 | 41 | 135 |
| 16.40 | 0.43 | 45 | 143 |
| 13.84 | 0.51 | 47.5 | 148 |
| 11.98 | 0.60 | 50 | 153 |
| 9.50 | 0.77 | 55 | 163 |

It was determined that by increasing the radius of curvature of the concave beveled surface 3011, it is possible to remove the visual variation whilst retaining a 'v-groove' aesthetic at the interface between two adjacent cladding elements 3000. However, if the radius of curvature is increased too much, then the 'v-groove' aesthetic at the interface between two adjacent cladding elements 3000 becomes an arc-like aesthetic which is less desirable. Accordingly, in one embodiment, it is preferable to adjust the beveled sloping surface 3010 by a distance $L_1$ to achieve a preferred tangential angle $t_1$. In one embodiment, the distance $L_1$ is between 0.27 and 0.51 mm and the preferred tangential angle $t_1$ is between approximately 40° and approximately 47.5°±1°.

In one preferred embodiment, cladding element 3000 is a fibre cement cladding element, comprising a hydraulic binder such as Portland cement, a silica source and fibres including cellulose fibres. It should be understood that other suitable materials known to a person skilled in the art, can also be included in the formulation. In one embodiment, the fibre cement cladding element is a medium density cladding element. In an alternative embodiment, the fibre cement cladding element is a low density cladding element.

In one embodiment, cladding element 3000 is provided with a either a smooth or a textured surface such as a wood effect texture or a render effect texture. Other suitable textures can also be provided as desired by an end-user, for example, brick or stone effect textures. For example, in some instances the first surface 3002 is provided with a smooth or textured surface. In other examples, both the first surface 3002 and the second surface 3004 are provided with a smooth or textured surface.

Cladding elements may be installed in cladding systems in conjunction with flashing strips, caulk, and/or other weatherproofing materials to reduce moisture transfer to the structure on which the cladding elements are installed. In some cases, it may be advantageous to provide weatherproofing structure on the cladding elements themselves to reduce or eliminate the need for additional weatherproofing materials and/or waterproofing installation steps. For example, the cladding elements may include one or more joint features configured to facilitate drainage of moisture from the assembled/installed cladding elements away from the structure on which the cladding elements are installed. The joint features can be configured to facilitate moisture drainage from the cladding elements as the cladding elements shrink and/or expand after installation (e.g., due to temperature change, evaporation, chemical processes, etc.). In some embodiments, the joint features create a tortuous and/or labyrinthine passage between a front side of the cladding elements and a back side of the elements, thereby reducing the amount of moisture passage between the front side of the cladding elements and the back side of the cladding elements when the cladding elements are installed on a wall or other structure. In some cases, cladding elements which include joint features are capable of being installed both vertically (e.g., having joint features on top and bottom sides of the cladding elements) and horizontally (e.g., having joint features on lateral sides of the cladding elements), depending on the application. Examples of such joint features are described below.

In further embodiments, the two further opposing side sections, not shown in the drawings which are located substantially perpendicularly to contoured side sections 3006, 3008 can also include features to enhance coupling with adjacent cladding elements located substantially perpendicular to contoured side sections 3006, 3008. Such features could include for example one or more of corresponding angled side surface or tongue and groove joints or stepped joints. In addition sealing elements such as for example caulk or other sealing materials can also be used to reduce moisture passage through the cladding system.

Although the embodiments has been described with reference to specific examples, it will be appreciated by those skilled in the art that the disclosure may be embodied in many other forms.

It is also contemplated that various combinations or sub-combinations of the specific features and aspects of the embodiments may be made and still fall within the scope of the disclosure. Accordingly, it should be understood that various features and aspects of the disclosed embodiments can be combined with or substituted for one another in order to form varying modes of the disclosed embodiment. Thus, it is intended that the scope of the present disclosure herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A cladding system comprising a plurality of cladding elements, the system comprising:

first and second cladding elements, each of the first and second cladding elements having:

a planar front face;

a rear face opposite the planar front face;

a first mating edge between the planar front face and the rear face, the first mating edge comprising:

a first recessed portion having a front-facing surface set rearward from the planar front face of the cladding element;

a first chamfer portion extending from the rear face of the cladding element toward the planar front face of the cladding element and away from a second mating edge of the cladding element;

a first concave arcuate beveled surface extending from the planar front face of the cladding element toward the first recessed portion and away from the second mating edge, the first concave arcuate beveled surface intersecting the planar front face at a first angle $t_1$ relative to the planar front face; and a first abutment face connecting the front-facing surface of the first recessed portion with the first concave arcuate beveled surface, wherein the first concave arcuate beveled surface intersects the first abutment face at a second angle smaller than $t_1$ relative to a plane parallel to the planar front face, and at an angle greater than 90° relative to the first abutment face;

the second mating edge between the front face and the rear face, opposite the first mating edge, the second mating edge comprising:

a second recessed portion having a rear-facing surface set forward from the rear face of the cladding element;

a second chamfer portion extending in a direction from the rear face of the cladding element toward the front face of the cladding element and toward the first mating edge;

a second concave arcuate beveled surface extending from the front face of the cladding element toward the recessed portion and away from the first mating edge; and a second abutment face connecting the rear-facing surface of the recessed portion with the concave arcuate beveled surface;

a first joint end between the front face and the rear face; and a second joint end between the front face and the rear face, opposite the first joint end;

wherein:

the first mating edge of the first cladding element is mated with the second mating edge of the second cladding element;

at least a portion of the first chamfer portion of the first cladding element contacts at least a portion of the second chamfer portion of the second cladding element; and the first concave arcuate beveled surface of the first cladding element is positioned adjacent the second concave arcuate beveled surface of the second cladding element to form an arcuate v-groove profile.

2. The system of claim 1, wherein the first angle $t_1$ is between approximately 32° and approximately 47.5°.

3. The system of claim 1, wherein the first angle $t_1$ is between approximately 40° and approximately 47.5°.

4. The system of claim 1, wherein the first concave arcuate beveled surface has a radius of curvature between approximately 67.61 mm and approximately 13.84 mm.

5. The system of claim 1, wherein the first concave arcuate beveled surface has a radius of curvature between approximately 26.30 mm and approximately 13.84 mm.

6. The system of claim 1, wherein the first concave arcuate beveled surface and the second concave arcuate beveled surface intersect the planar front face at approximately the same tangential angle.

7. The system of claim 1, wherein the first concave arcuate beveled surface and the second concave arcuate beveled surface have approximately the same radius of curvature.

8. The system of claim 1, wherein the arcuate v-groove profile extends along an entire length of each of the first and second cladding elements with no visibly perceptible variations in a width of the v-groove profile.

9. The system of claim 1, wherein the first and second cladding elements comprise fibre cement.

10. A cladding element comprising:

a planar front face;

a rear face opposite the planar front face;

a first mating edge between the planar front face and the rear face, the first mating edge comprising:

a first recessed portion having a front-facing surface set rearward from the planar front face of the cladding element;

a first chamfer portion extending from the rear face of the cladding element toward the planar front face of the cladding element and away from a second mating edge of the cladding element;

a first concave arcuate beveled surface extending from the planar front face of the cladding element toward the first recessed portion and away from the second mating edge, the first concave arcuate beveled surface intersecting the planar front face at a first angle $t_1$ relative to the planar front face; and a first abutment face connecting the front-facing surface of the first recessed portion with the first concave arcuate beveled surface, wherein the first concave arcuate beveled surface intersects the first abutment face at a second angle smaller than $t_1$ relative to a plane parallel to the planar front face, and at an angle greater than 90° relative to the first abutment face;

the second mating edge between the front face and the rear face, opposite the first mating edge, the second mating edge comprising:

a second recessed portion having a rear-facing surface set forward from the rear face of the cladding element;

a second chamfer portion extending in a direction from the rear face of the cladding element toward the front face of the cladding element and toward the first mating edge;

a second concave arcuate beveled surface extending from the front face of the cladding element toward the recessed portion and away from the first mating edge; and a second abutment face connecting the rear-facing surface of the recessed portion with the concave arcuate beveled surface;

a first joint end between the front face and the rear face; and a second joint end between the front face and the rear face, opposite the first joint end.

11. The system of claim 10, wherein the first angle $t_1$ is between approximately 32° and approximately 47.5°.

12. The system of claim 10, wherein the first angle $t_1$ is between approximately 40° and approximately 47.5°.

13. The system of claim 10, wherein the first concave arcuate beveled surface has a radius of curvature between approximately 67.61 mm and approximately 13.84 mm.

14. The system of claim 10, wherein the first concave arcuate beveled surface has a radius of curvature between approximately 26.30 mm and approximately 13.84 mm.

15. The system of claim 10, wherein the first concave arcuate beveled surface and the second concave arcuate beveled surface intersect the front face at approximately the same tangential angle.

16. The system of claim 10, wherein the first concave arcuate beveled surface and the second concave arcuate beveled surface have approximately the same radius of curvature.

17. The system of claim 10, wherein the first and second cladding elements comprise fibre cement.

* * * * *